US006012657A

United States Patent [19]

Knobbe et al.

[11] Patent Number: 6,012,657

[45] Date of Patent: Jan. 11, 2000

[54] POWDER SPRAY HEAD FOR FAN-LIKE PATTERNS

[75] Inventors: Alan J. Knobbe, Amherst; Terrence M. Fulkerson, Parma; Hector L. Serrano, Lorain; John C. A. Traylor, Elyria; Frank DeAngelis, Amherst, all of Ohio

[73] Assignee: Nordson Corporation, Cleveland, Ohio

[21] Appl. No.: 08/943,901

[22] Filed: Oct. 3, 1997

[51] Int. Cl.[7] ..... B05B 5/00; B05B 1/14

[52] U.S. Cl. ..... 239/697; 239/390; 239/568; 239/590.5; 239/593; 239/600; 239/696

[58] Field of Search ..... 239/690, 696, 239/697, 698, 690.1, 704, 706, 707, 505, 518, 523, 390, 590, 593, 601, 600, 568, 590.5

[56] References Cited

U.S. PATENT DOCUMENTS

| | | | |
|---|---|---|---|
| 2,651,287 | 9/1953 | Turner . | |
| 2,685,536 | 8/1954 | Starkey et al. . | |
| 2,695,002 | 11/1954 | Miller . | |
| 2,706,964 | 4/1955 | Ransburg et al. . | |
| 2,718,477 | 9/1955 | Miller . | |
| 2,723,646 | 11/1955 | Ransburg . | |
| 2,748,018 | 5/1956 | Miller . | |
| 2,785,088 | 3/1957 | Ransburg . | |
| 2,803,496 | 8/1957 | Ransburg . | |
| 3,195,819 | 7/1965 | Watanabe | 239/696 X |
| 3,263,127 | 7/1966 | Point et al. | 239/697 X |
| 3,870,232 | 3/1975 | Lacchia . | |
| 4,110,486 | 8/1978 | Lacchia . | |
| 4,630,777 | 12/1986 | Hollstein et al. . | |
| 4,715,535 | 12/1987 | Mulder . | |
| 4,811,898 | 3/1989 | Murphy | 239/697 X |
| 4,819,879 | 4/1989 | Sharpless et al. | 239/698 X |
| 4,830,279 | 5/1989 | Crum et al. . | |
| 4,830,872 | 5/1989 | Grenfell | 329/690 X |
| 4,986,210 | 1/1991 | Hollstein et al. . | |
| 5,400,976 | 3/1995 | Kaijyu et al. | 239/704 X |
| 5,518,344 | 5/1996 | Miller et al. . | |
| 5,582,347 | 12/1996 | Knobbe et al. . | |
| 5,868,323 | 2/1999 | Cantor | 239/601 X |

OTHER PUBLICATIONS

Nordson Corporation Drawing No. 141,046 dated Apr. 19, 1991 and entitled "Nozzle, Flatspray, 4 mm, Illustrating the Nozzle for the Versa Spray Gun". Th drawing has been modified by deletion of dimensions from the drawing and by deletion of revision dates and identification.

*Primary Examiner*—Andres Kashnikow
*Assistant Examiner*—Sean P. O'Hanlon
*Attorney, Agent, or Firm*—Calfee, Halter & Griswold LLP

[57] ABSTRACT

An improved apparatus for applying coating material includes a spray head having a housing which encloses a deflector. The deflector and housing cooperate to form a plurality of coating material flow channels which diverge in a direction of flow of coating material through the spray head. The deflector and housing cooperate to define a long thin outlet with relatively wide channel outlet sections at opposite ends of the outlet. An electrode assembly includes an electrode element having a long thin surface area which extends between opposite end portions of the long thin outlet and is exposed to the flow of coating material through the outlet. A wear tube encloses a portion of the electrode assembly and connects the deflector with the housing. The electrode element may be a plate which is molded into the deflector with a minor edge portion of the plate exposed to the flow of coating material.

64 Claims, 15 Drawing Sheets

| POSITION | LOW FLOW MILS | HIGH FLOW MILS |
|---|---|---|
| −1 | 0.0 | 0.0 |
| −2 | 0.0 | 0.0 |
| −3 | 0.0 | 0.0 |
| −4 | 0.0 | 0.0 |
| −5 | 0.0 | 0.1 |
| −6 | 0.0 | 0.0 |
| −7 | 0.0 | 0.0 |
| −8 | 0.0 | 0.1 |
| −9 | 0.0 | 0.0 |
| −10 | 0.0 | 0.1 |
| −11 | 0.0 | 0.0 |
| −12 | 0.0 | 0.0 |
| −13 | 0.1 | 0.1 |
| −14 | 0.2 | 0.2 |
| −15 | 0.3 | 0.2 |
| −16 | 0.3 | 0.3 |
| −17 | 0.4 | 0.5 |
| −18 | 0.6 | 0.6 |
| −19 | 0.7 | 0.8 |
| −20 | 0.8 | 1.0 |
| −21 | 1.0 | 1.2 |
| −22 | 1.4 | 1.7 |
| −23 | 1.8 | 1.9 |
| −24 | 2.1 | 2.7 |
| −25 | 2.7 | 2.8 |
| −26 | 3.0 | 2.7 |
| −27 | 2.8 | 3.7 |
| −28 | 3.2 | 3.5 |
| −29 | 2.9 | 3.6 |
| −30 | 2.7 | 3.4 |
| −31 | 3.3 | 3.2 |
| −32 | 3.3 | 3.2 |
| −33 | 2.3 | 3.0 |
| −34 | 2.0 | 2.9 |
| −35 | 1.7 | 2.4 |
| −36 | 1.2 | 1.7 |
| −37 | 0.9 | 1.1 |
| −38 | 0.6 | 0.8 |
| −39 | 0.4 | 0.6 |
| −40 | 0.2 | 0.3 |
| −41 | 0.2 | 0.2 |
| −42 | 0.1 | .0.2 |
| −43 | 0.2 | 0.2 |
| −44 | 0.3 | 0.2 |
| −45 | 0.2 | 0.2 |
| −46 | 0.1 | 0.1 |
| −47 | 0.2 | 0.1 |
| −48 | 0.0 | 0.0 |
| −49 | 0.0 | 0.1 |
| −50 | 0.0 | 0.2 |
| −51 | 0.0 | 0.0 |
| −52 | 0.0 | 0.0 |
| −53 | 0.0 | 0.0 |
| −54 | 0.0 | 0.0 |
| −55 | 0.0 | 0.0 |
| −56 | 0.0 | 0.0 |
| −57 | 0.0 | 0.0 |
| −58 | 0.0 | 0.0 |
| −59 | 0.0 | 0.0 |

| POSITION | LOW FLOW MILS | HIGH FLOW MILS |
|---|---|---|
| −1 | 0.0 | 0.0 |
| −2 | 0.0 | 0.0 |
| −3 | 0.0 | 0.0 |
| −4 | 0.0 | 0.0 |
| −5 | 0.0 | 0.1 |
| −6 | 0.0 | 0.0 |
| −7 | 0.0 | 0.2 |
| −8 | 0.0 | 0.2 |
| −9 | 0.1 | 0.3 |
| −10 | 0.1 | 0.2 |
| −11 | 0.2 | 0.2 |
| −12 | 0.3 | 0.3 |
| −13 | 0.4 | 0.4 |
| −14 | 0.5 | 0.5 |
| −15 | 0.7 | 0.7 |
| −16 | 0.9 | 0.9 |
| −17 | 1.2 | 1.2 |
| −18 | 1.4 | 1.5 |
| −19 | 1.7 | 1.8 |
| −20 | 1.8 | 2.1 |
| −21 | 2.0 | 2.2 |
| −22 | 2.0 | 2.4 |
| −23 | 2.2 | 2.4 |
| −24 | 2.1 | 2.6 |
| −25 | 2.6 | 3.1 |
| −26 | 2.8 | 3.2 |
| −27 | 3.0 | 3.0 |
| −28 | 3.0 | 2.6 |
| −29 | 2.9 | 2.7 |
| −30 | 2.7 | 2.5 |
| −31 | 3.0 | 2.9 |
| −32 | 3.1 | 3.0 |
| −33 | 3.2 | 3.6 |
| −34 | 3.0 | 3.1 |
| −35 | 2.8 | 2.8 |
| −36 | 2.5 | 2.6 |
| −37 | 2.3 | 2.0 |
| −38 | 2.3 | 2.3 |
| −39 | 2.2 | 2.0 |
| −40 | 2.0 | 1.9 |
| −41 | 1.8 | 1.9 |
| −42 | 1.8 | 2.1 |
| −43 | 1.5 | 1.8 |
| −44 | 1.1 | 1.4 |
| −45 | 0.8 | 0.9 |
| −46 | 0.6 | 0.8 |
| −47 | 0.5 | 0.6 |
| −48 | 0.3 | 0.5 |
| −49 | 0.2 | 0.6 |
| −50 | 0.4 | 0.3 |
| −51 | 0.4 | 0.2 |
| −52 | 0.3 | 0.3 |
| −53 | 0.2 | 0.2 |
| −54 | 0.1 | 0.3 |
| −55 | 0.0 | 0.2 |
| −56 | 0.1 | 0.2 |
| −57 | 0.1 | 0.3 |
| −58 | 0.1 | 0.2 |
| −59 | 0.0 | 0.0 |

| POSITION | LOW FLOW MILS | HIGH FLOW MILS |
|---|---|---|
| −1 | 0.0 | 00 |
| −2 | 0.0 | 00 |
| −3 | 0.0 | 00 |
| −4 | 0.0 | 00 |
| −5 | 0.0 | 02 |
| −6 | 0.0 | 0.2 |
| −7 | 0.0 | 0.2 |
| −8 | 0.0 | 0.3 |
| −9 | 0.0 | 0.3 |
| −10 | 0.0 | 0.2 |
| −11 | 0.0 | 0.3 |
| −12 | 0.0 | 0.3 |
| −13 | 0.1 | 0.2 |
| −14 | 0.2 | 0.3 |
| −15 | 0.2 | 0.3 |
| −16 | 0.2 | 0.4 |
| −17 | 0.4 | 0.5 |
| −18 | 0.5 | 0.5 |
| −19 | 0.6 | 0.6 |
| −20 | 0.6 | 0.8 |
| −21 | 0.8 | 1.1 |
| −22 | 0.8 | 1.6 |
| −23 | 1.1 | 2.0 |
| −24 | 1.5 | 2.8 |
| −25 | 1.8 | 3.6 |
| −26 | 2.3 | 4.8 |
| −27 | 3.4 | 5.6 |
| −28 | 4.3 | 6.7 |
| −29 | 4.5 | 6.6 |
| −30 | 4.8 | 6.7 |
| −32 | 3.2 | 6.8 |
| −33 | 2.4 | 6.0 |
| −34 | 1.8 | 4.7 |
| −35 | 1.5 | 3.9 |
| −36 | 1.1 | 3.1 |
| −37 | 0.8 | 2.4 |
| −38 | 0.6 | 1.7 |
| −39 | 0.5 | 1.2 |
| −40 | 0.3 | 1.0 |
| −41 | 0.2 | 0.6 |
| −42 | 0.2 | 0.5 |
| −43 | 0.3 | 0.4 |
| −44 | 0.1 | 0.3 |
| −45 | 0.2 | 0.4 |
| −46 | 0.1 | 0.3 |
| −47 | 0.0 | 0.3 |
| −48 | 0.0 | 0.2 |
| −49 | 0.0 | 0.2 |
| −50 | 0.0 | 0.1 |
| −51 | 0.0 | 0.2 |
| −52 | 0.0 | 0.1 |
| −53 | 0.0 | 0.1 |
| −54 | 0.0 | 0.1 |
| −55 | 0.0 | 0.1 |
| −56 | 0.0 | 0.1 |
| −57 | 0.0 | 0.1 |
| −58 | 0.0 | 0.0 |
| −59 | 0.0 | 0.0 |

POWDER SPRAY HEAD FOR FAN-LIKE PATTERNS

BACKGROUND OF THE INVENTION

An improved apparatus for applying coating material to an object includes a spray head from which a fan-like flow of coating material is directed towards the object.

A known apparatus for use in applying coating material (powder) to an object includes an electrostatic spray gun having a nozzle with an outlet slot. This known electrostatic spray gun is generally satisfactory in its operation and is commercially available from Nordson Corporation of Amherst, Ohio under the designation of "Versa Spray II" (trademark) with a 4 mm flat spray nozzle.

Other known apparatus for use in applying coating material to an object includes a spray gun having a nozzle and a deflector which directs the flow of coating material toward the object. This apparatus includes an electrode assembly which electrostatically charges particles of the coating material (powder) entrained in a flow of air. The electrode assembly includes a porous electrode sheet which is disposed in the deflector and has edge portions which are exposed to the flow of coating material. A spray gun having this construction is disclosed in U.S. Pat. No. 5,582,347. Another known spray gun for applying coating material to an object is disclosed in U.S. Pat. No. 4,819,879.

SUMMARY OF THE INVENTION

The present invention provides a new and improved apparatus for use in applying coating material to an object. The apparatus includes a spray head having a long thin outlet through which the coating material is conducted from the spray head. The long thin outlet has a central portion which extends between end portions of the outlet. The coating material is conducted through the central portion of the outlet at a flow rate which is less than the rate of flow of coating material through the end portions of the outlet.

The spray head may be formed by a deflector which is at least partially enclosed by a housing. The deflector and housing cooperate to form a plurality of channels which diverge in the direction of flow of coating material through the spray head. The channels conduct the flow of coating material to opposite end portions of the long thin outlet. A thin slot channel may be disposed in the spray head to conduct a flow of coating material to a central portion of the outlet.

An electrode assembly may be connected with the spray head to electrostatically charge the coating material. The electrode assembly includes an electrode element having a long thin surface area. The long thin surface area on the electrode element extends between opposite end portions of the long thin outlet and is exposed to the flow of coating material through the outlet. In alternative embodiments of the spray head, the electrode element is formed by one or more wires.

The deflector and the housing of the spray head may be interconnected by a wear tube. The wear tube encloses a portion of the electrode assembly to shield a portion of the electrode assembly from a flow of coating material. The wear tube transmits forces between the deflector and the housing to hold them against movement relative to each other.

BRIEF DESCRIPTION OF THE DRAWINGS

The foregoing and other features of the invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
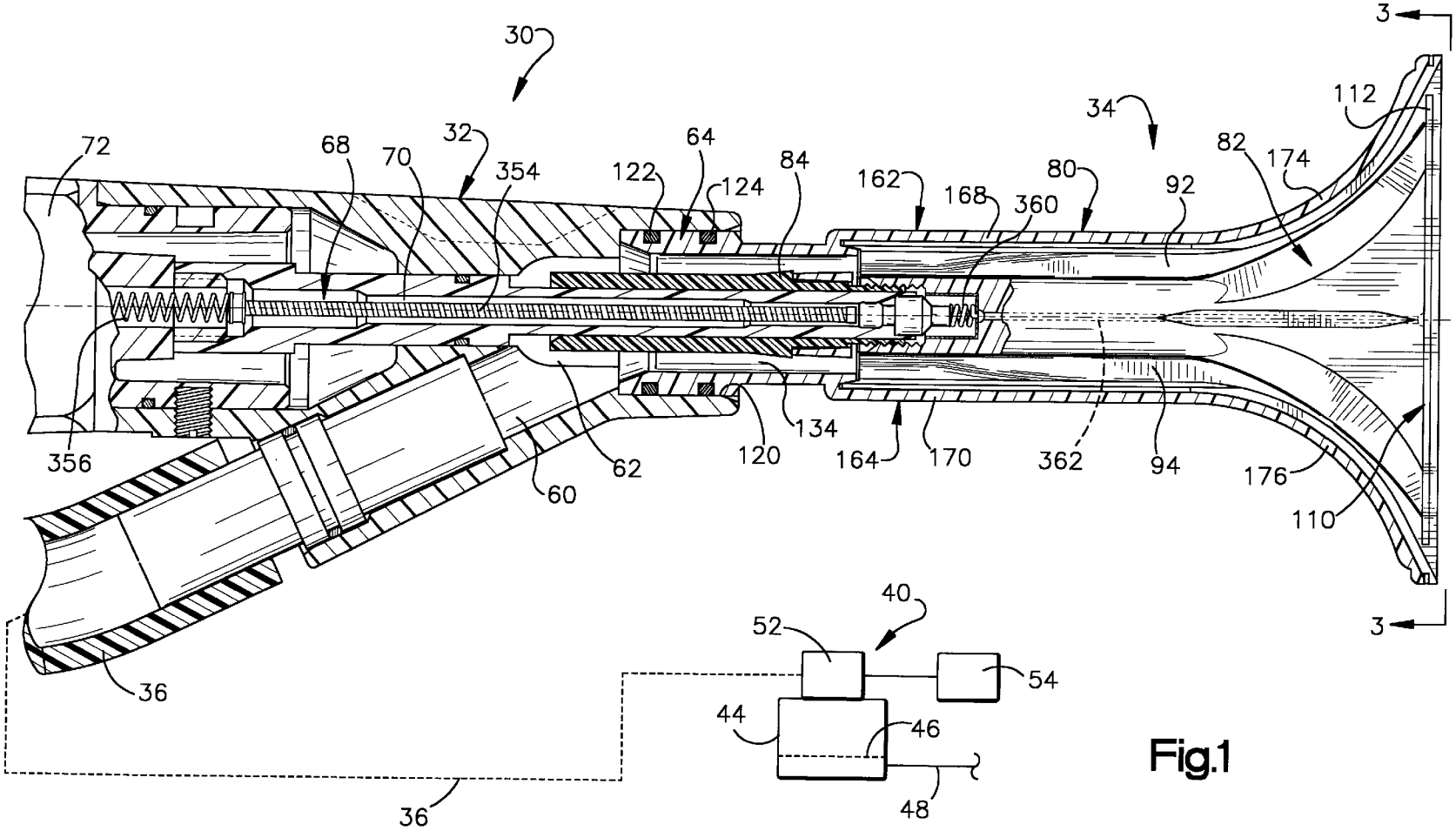
FIG. 1 is a fragmentary sectional view illustrating an apparatus constructed in accordance with the present invention to apply coating material to an object.

An apparatus or spray gun 30 (FIG. 1) directs a flow of air with coating material entrained therein, toward an object or workpiece (not shown). The spray gun 30 includes a housing assembly 32 through which a flow of air with coating material entrained therein, is conducted to an improved spray head 34 constructed in accordance with the present invention. The flow of air with coating material entrained therein is conducted to the housing assembly 32 through a delivery conduit 36.

A powder supply apparatus 40 (FIG. 1) controls the flow of air entrained coating material to the delivery conduit 36. The powder supply apparatus 40 includes a fluidizing bed powder container or hopper 44 which contains coating material, specifically, powder. A bottom fluidizing plate 46 of porous material is disposed in the hopper 44. Fluidizing air is conducted through a conduit 48 to the hopper 44.

The fluidizing air conducted through the conduit 48 to the hopper 44 is directed upward through the fluidizing bed bottom plate 46 into the upper portion of the hopper 44. The flow of fluidizing air through the bed plate 46 fluidizes the powder in the upper portion of the hopper 44 in a known manner. If desired, a mechanical agitator may be provided in the upper portion of the hopper 44 to promote fluidization of the powder.

The fluidized powder or coating material is conducted from the hopper 44 through a venturi pump 52. Operation of the venturi pump 52 is controlled by a gun control module 54. The gun control module 54 determines the timing and pressure of air supplied to the venturi pump 52 to achieve the desired powder flow to the spray gun 30 through the delivery conduit 36. The general construction and mode of operation of the powder supply apparatus 40 may be the same as is disclosed in U.S. Pat. No. 5,518,344 issued May 21, 1996 to Miller et al. and entitled "Apparatus for Transporting Powder Coating Material From a Box-Shaped Container". The disclosure in the aforementioned U.S. Pat. No. 5,518,344 is hereby incorporated herein by this reference thereto.

The flow of air with particles of powder (coating material) entrained therein is conducted from the delivery conduit 36 through an inlet passage 60 to an outer central passage 62 in the housing assembly 32. The outer central passage 62 extends to an inlet end portion 64 of the spray head 34. The inlet end portion 64 of the spray head 34 is telescopically received in an end portion of the housing assembly 32. The flow of air entrained powder is conducted to the spray head 34 and is directed toward an article with a flat, thin fan-like spray by the spray head 34.

An electrode assembly 68 (FIG. 1) is disposed within a central passage 70 in the housing assembly 32. The electrode assembly 68 extends from a voltage multiplier 72 through the housing assembly 32 into the spray head 34. The voltage multiplier 72 supplies a relatively high voltage, in the illustrated embodiment of the invention, about 100,000 volts to the electrode assembly 68. The electrode assembly 68 electrostatically charges particles of powder entrained in the flow of air discharged from the spray head 34 toward the workpiece or object to be coated.

It is contemplated that the spray gun 30 could have many different constructions. In the illustrated embodiment of the spray gun 30, the spray gun is constructed so as to be mounted on a stationary base or frame. The workpiece or object to be coated is moved past the spray head 34. If desired, the spray gun 30 could be mounted on a support which is moved relative to the workpiece. It is contemplated that the spray gun 30 could be configured to be manually grasped by an operator of the spray gun in a manner similar to that illustrated in U.S. Pat. No. 5,056,720, issued Oct. 15, 1991 and entitled "Electrostatic Spray Gun".

The general construction of the housing assembly 32 and the portion of the electrode assembly 68 disposed in the housing assembly is the same as is disclosed in U.S. Pat. No. 5,582,347 issued to Knobbe et al. on Dec. 10, 1996 and entitled "Particle Spray Apparatus and Method". The disclosure in the aforementioned U.S. Pat. No. 5,582,347 is hereby incorporated herein by this reference thereto.

The improved spray head 34 (FIGS. 1 and 2) includes a housing or nozzle 80 on which the inlet end portion 64 of the spray head 34 is disposed. A deflector 82 is connected with the housing 80 and is partially enclosed by the housing. In accordance with a feature of the invention, a wear sleeve or tube 84 interconnects the deflector 82 and housing 80. In addition, the wear sleeve or tube 84 encloses a portion of the electrode assembly 68 (FIG. 1) to protect the electrode assembly against abrasion by the flow of coating material.

The housing 80 and deflector 82 cooperate to define a long thin outlet or opening 88 (FIG. 3) from which a flat, thin fan-like flow of electrostatically charged coating material (powder) is conducted toward the object to be coated. The flat, thin fan-like flow of coating material is applied to the object in a coating having a relatively uniform thickness. There is a relatively high transfer efficiency of the coating material (powder) to the object to be coated.

In accordance with a feature of the invention, the deflector 82 (FIGS. 1 and 2) cooperates with the housing 80 to form upper and lower channels 92 and 94 through which coating material (powder) is conducted to upper and lower channel outlet portions 96 and 98 (FIG. 3) of the long thin outlet 88 from the spray head 34. The upper and lower channel outlet portions 96 and 98 of the spray head outlet 88 are disposed at opposite end portions of the outlet.

The deflector 82 and housing 80 (FIGS. 1 and 2) cooperate to define a shallow connector or slot channel 102 (FIG. 2) which extends between the upper and lower channels 92 and 94. The channels 92, 94 and 102 are formed by cooperation between an outer side of the deflector 82 and an inner side of the housing 80. The connector or slot channel 102 is aligned with a narrow slot outlet portion 104 (FIG. 3) of the long thin outlet 88.

The slot outlet portion 104 extends between the upper and lower channel outlet portions 96 and 98 of the outlet 88. The slot outlet portion 104 of the long thin outlet 88 is aligned with an end of the slot channel 102 (FIG. 2) formed between the deflector 82 and the housing 80. The upper channel outlet portion 96 of the long thin outlet 88 (FIG. 3) is aligned with an end of the upper channel 92 (FIGS. 1 and 2) formed between the deflector 82 and the housing 80. The lower channel outlet portion 98 (FIG. 3) of the long thin outlet 88 is aligned with an end the lower channel 94 (FIGS. 1 and 2) formed between the deflector 82 and housing 80.

The deflector 82 and housing 80 cooperate to direct the flow of coating material (powder) from the channel outlet portions 96 and 98 of the long thin outlet 88 in diverging directions. Thus, the deflector 82 and housing 80 cooperate to direct the flow of coating material from the upper channel outlet portion 96 upward (as viewed in FIG. 3). Similarly, the deflector 82 and housing 80 cooperate to direct the flow of coating material from the lower channel outlet portion 98 downward (as viewed in FIG. 3). By having the flow of coating material from the upper and lower channel outlet portions 96 and 98 diverge from the flow of coating material through the slot outlet portion 104, a thin fan-like spray of coating material is achieved. This thin fan-like spray of coating material enables the coating material to be evenly applied to a relatively large surface area on an object or workpiece.

Figure 3:
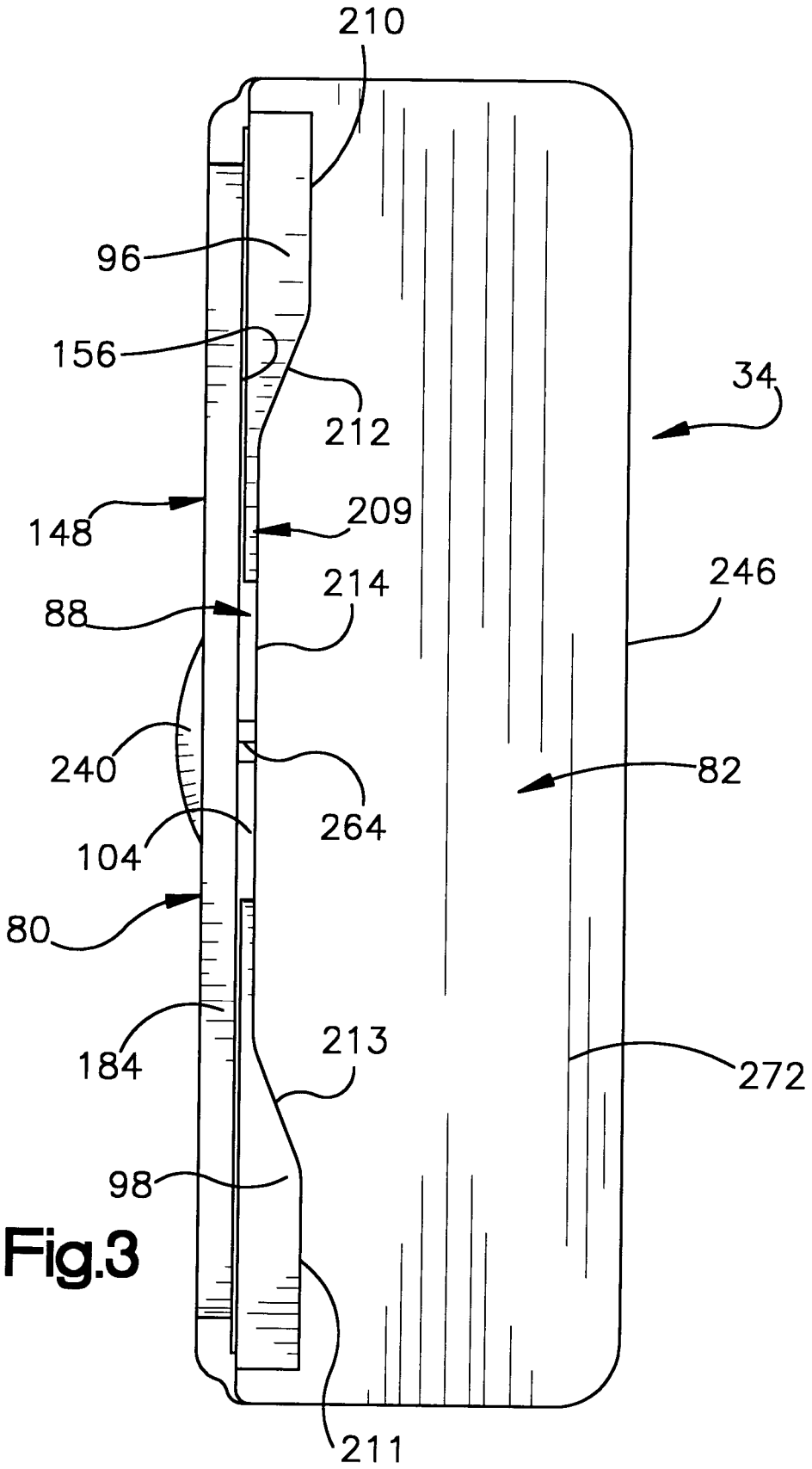
FIG. 3 is an end view, taken generally along the line 3—3 of FIG. 1, illustrating a long thin outlet from the spray head.

In accordance with another feature of the invention, the electrode assembly 68 (FIG. 1) includes an electrode element 110 (FIGS. 16 and 17) having a long thin surface area 112. The long thin surface area 112 (FIG. 1) on the electrode element 110 is substantially coextensive with the long thin outlet 88 (FIG. 3). The long thin surface area 112 (FIG. 1) on the electrode element 110 is disposed a small distance upstream from the long thin outlet 88 (FIG. 3) to shield the long thin surface area 112 on the electrode element 110 from the environment around the spray head 34. During operation of the spray gun 30, an electric field emanates from the long thin surface area 112 of the electrode element 110 to electrostatically charge particles of the coating material.

Housing

The housing 80 (FIGS. 1, 2, 3, 4, 5, 6, 7, and 8) cooperates with the deflector 82 (FIGS. 1, 2, 9, 10, 11, 12, 13, and 14) to form the upper and lower channels 92 and 94 and slot channel 102 through which coating material flows and to form the long thin outlet 88 (FIG. 3). The housing 80 (FIG. 2) is integrally molded as one piece of an electrically insulating polymeric material. However, it should be understood that the housing 80 could be formed of other electrically insulating materials and could be formed in a different manner if desired.

The inlet portion 64 (FIGS. 4 and 5) of the housing 80 has a generally cylindrical configuration and is received in a cylindrical opening 120 (FIG. 1) in the outer end portion of the spray gun housing assembly 32. A pair of annular O-ring seals 122 and 124 are disposed in annular grooves 128 and 130 (FIGS. 4 and 5) formed in the inlet end portion 64 of the housing 80. The O-ring seals 122 and 124 (FIG. 1) cooperate with the outer end portion of the housing assembly 32 to block leakage of coating material (powder) between the inlet end portion 64 of the housing 80 and the housing assembly 32.

The coating material flows from the delivery conduit 36 (FIG. 1) through the inlet passage 60 into the inlet end portion 64 of the housing 80. The flow of coating material enters a cylindrical inlet passage 134 in the inlet portion 64 of the housing 80. The flow of coating material is conducted from the inlet passage 134 into a deflector receiving cavity 138 (FIGS. 4 and 5).

The deflector receiving cavity 138 and deflector 82 both have rectangular cross sectional configurations, as viewed in planes perpendicular to a longitudinal central axis of the spray head 34, throughout the length of the cavity 138 and deflector 82. The cavity 138 has a linear inlet portion 140 and an outwardly flaring outlet portion 142 (FIGS. 4 and 5). The linear inlet portion 140 of the deflector receiving cavity 138 is disposed between flat generally parallel left and right major side walls 146 and 148 (FIGS. 4, 5 and 8) of the housing 80. As used herein, the terms "left" and "right" will be as viewed by an operator of the spray gun.

The flat generally parallel major side walls 146 and 148 of the housing 80 extend from the inlet portion 64 to a rectangular outer end 150 of the housing 80. The left and right major side walls 146 and 148 of the housing 80 have flat generally parallel inner major side surfaces 154 and 156. Since the housing 80 is molded, the side walls 146 and 148 are not exactly parallel to facilitate removing the housing from a mold.

Figure 4:
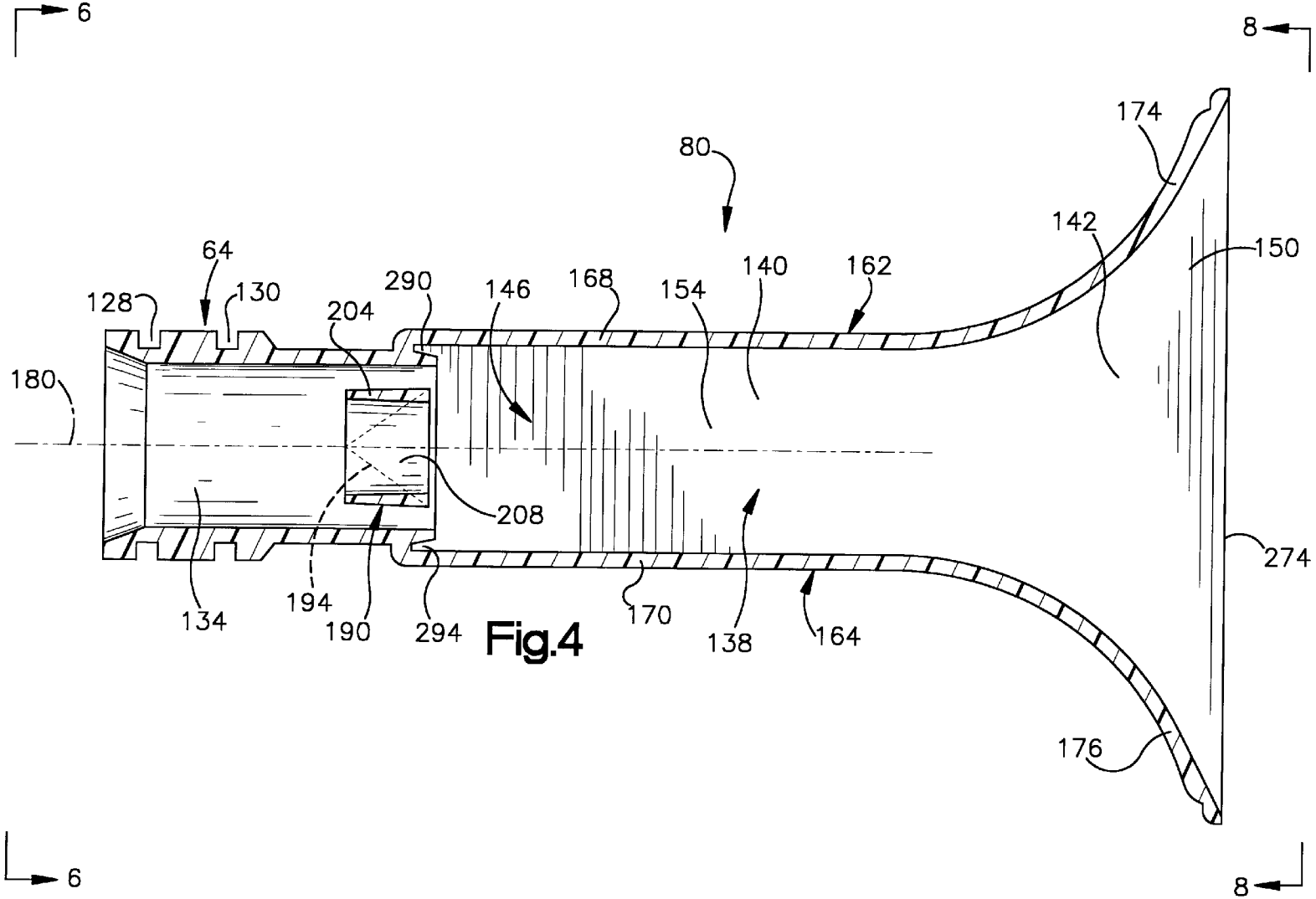
FIG. 4 is a sectional view, taken generally along the line 4—4 of FIG. 2, illustrating the construction of a housing which forms part of the spray head.
Figure 5:
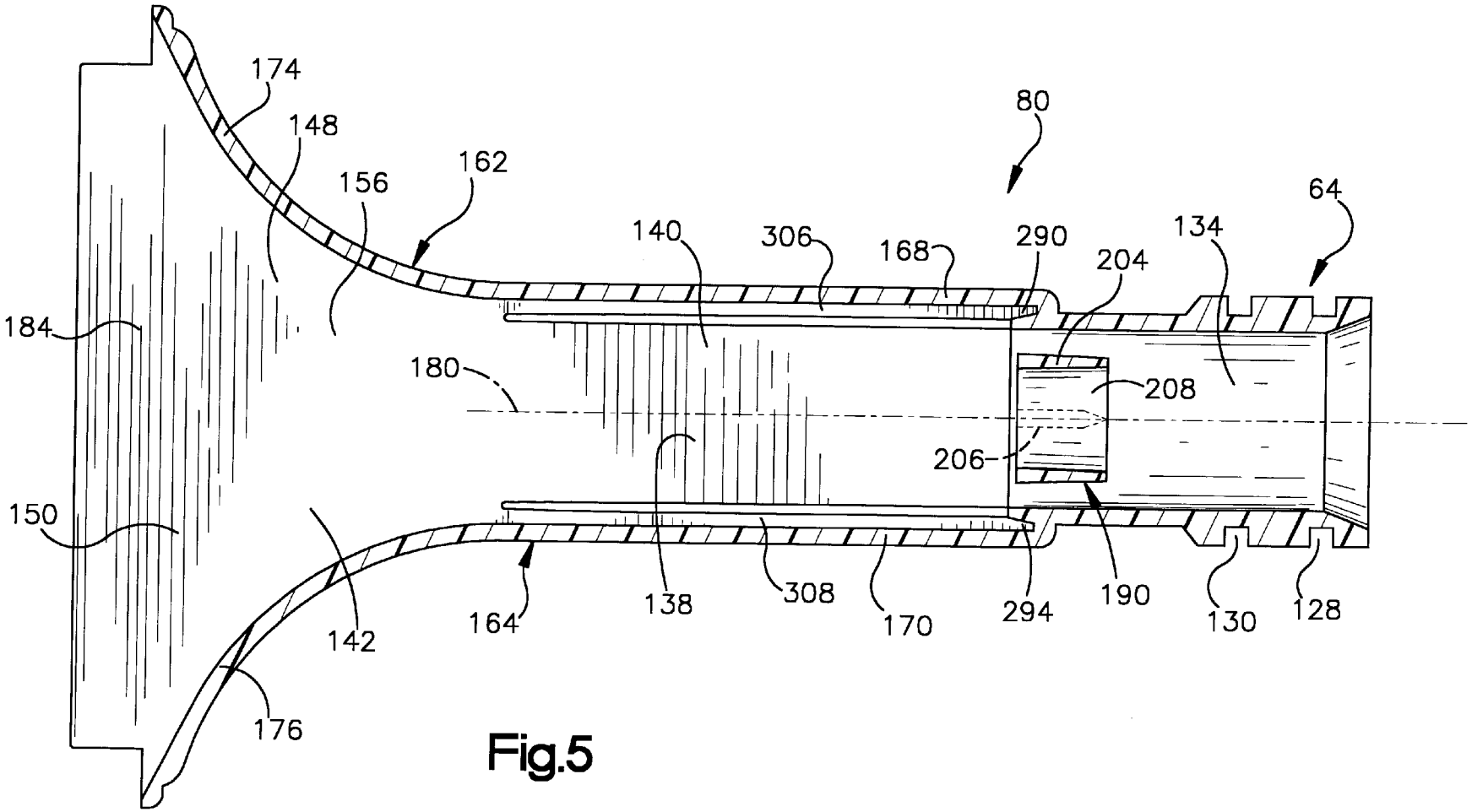
FIG. 5 is a sectional view, taken generally along the line 5—5 of FIG. 2, further illustrating the construction of the housing.
Figure 8:
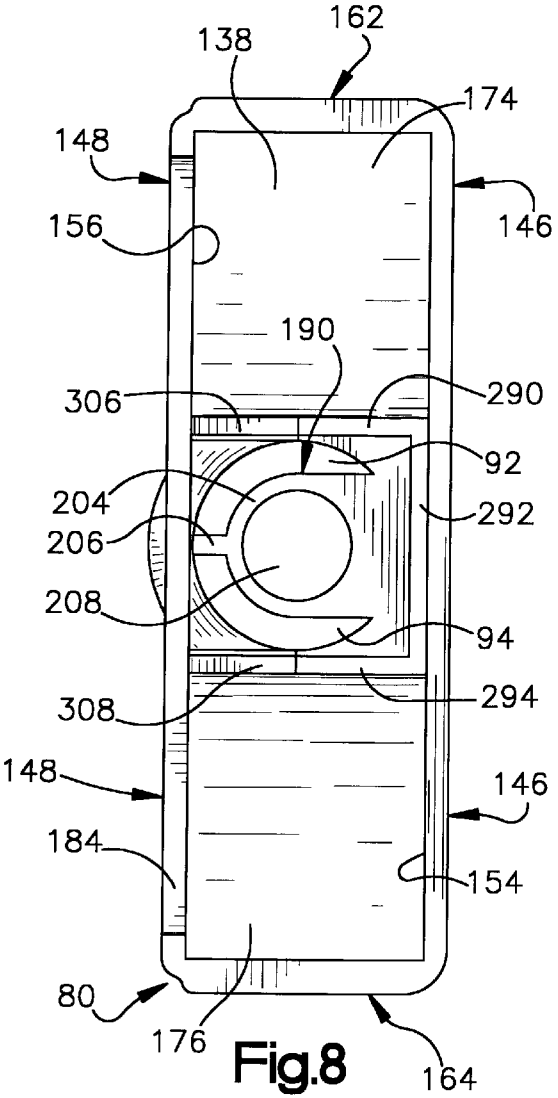
FIG. 8 is an outlet end view of the housing, taken generally along the line 8—8 of FIG. 4, illustrating the relationship of recesses or grooves of tongue and groove seals to the support section of the housing.
Figure 7:
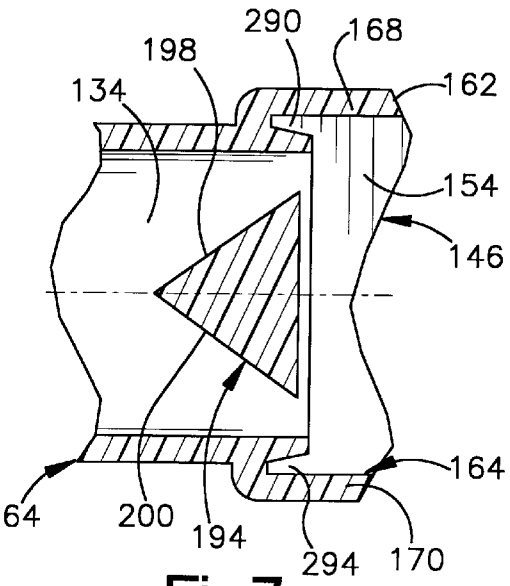
FIG. 7 is a fragmentary sectional view, taken generally along the line 7—7 of FIG. 6, further illustrating the construction of the flow divider.
Figure 6:
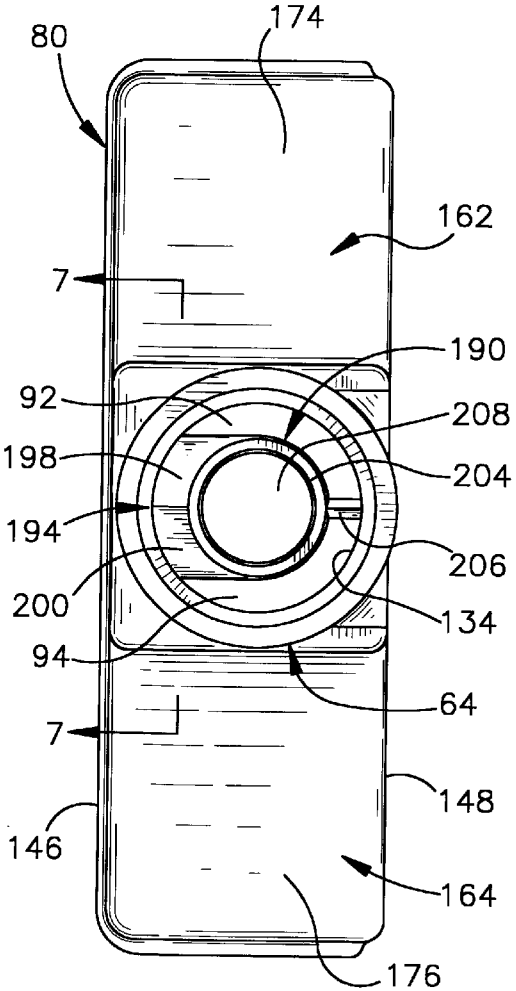
FIG. 6 is an inlet end view of the housing, taken generally along the line 6—6 of FIG. 4, illustrating a support or spider section and a flow divider disposed in an inlet passage in the housing.

The left and right major side walls 146 and 148 of the housing 80 are interconnected by upper and lower minor side walls 162 and 164 (FIGS. 4, 5 and 8). The upper and lower minor side walls 162 and 164 extend perpendicular to the major side walls 146 and 148 of the housing 80. The upper minor side wall 162 of the housing 80 (FIG. 4) includes a linear section 168. Similarly, the lower minor side wall 164 includes a linear section 170 which extends generally parallel to the linear section 168 of the upper minor side wall 162.

In addition, the upper and lower minor side walls 162 and 164 include arcuate sections 174 and 176 which flare outward from a longitudinal central axis 180 (FIGS. 4 and 5) of the housing 80. The arcuate sections 174 and 176 flare in opposite directions from the longitudinal central axis 180 of the housing. Thus, the arcuate section 174 flares upward while the arcuate section 176 flares downward.

A rectangular visor or lip 184 (FIGS. 2 and 5) is formed as a continuation of the right major side wall 148. The visor or lip 184 forces the ions to flow in the same direction as the powder to more effectively charge the powder. The visor or lip 184 extends outward past the left major side wall 146 of the housing 80,to partially shield the electrostatically charged flow of coating material from the electrically grounded object or workpiece as the coating material leaves the long thin outlet 88. In addition, the visor or lip 184 shields the long thin surface area 112 (FIGS. 9 and 17) on the electrode element 110 from the electrically grounded workpiece or object to which the coating material is being applied.

A support section or spider 190 (FIGS. 4, 5 and 6) is integrally molded as one piece with the inlet portion 64 of the housing 80. The support section or spider 190 is disposed adjacent to a junction between the inlet portion 64 of the housing 80 and the deflector receiving cavity 138 (FIGS. 4 and 5). The support section or spider 190 (FIG. 6) includes a flow divider 194. The flow divider 194 splits the flow of coating material in the inlet passage 134 between the upper and lower channels 92 and 94 (FIGS. 1 and 2) formed between the deflector 82 and housing 80.

The flow divider 194 (FIGS. 6 and 7) includes a pair of side surfaces 198 and 200 which intersect to form a V-shaped body in the flow of coating material through the cylindrical inlet passage 134. The side surface 198 on the flow divider 194 deflects a portion of the flow in the inlet passage 194 upward (as viewed in FIG. 6) toward the upper channel 92. The lower side surface 200 on the flow divider 194 deflects coating material flowing through the inlet passage 134 downward toward the lower channel 94.

In addition to the flow divider 194, the support section or spider 190 includes a generally cylindrical support wall 204 (FIGS. 4, 5 and 6) through which the wear tube 84 (FIG. 2) extends. A strut 206 (FIG. 6) connects the support wall 204 with the generally cylindrical inlet end portion 64 of the housing 80. A cylindrical passage 208 extends through the support wall 204 and has a central axis which is coincident with the central axis 180 of the housing 80.

Deflector

The deflector 82 (FIG. 9) cooperates with the housing 80 (FIGS. 4 and 5) to define the long thin outlet 88 (FIG. 3). The deflector 82 also cooperates with the housing 80 to define the upper and lower channels 92 and 94 (FIG. 9) through which a flow of coating material is conducted to the upper channel outlet portion 96 (FIG. 3) and lower channel outlet portion 98 of the long thin outlet 88. In addition, the deflector 82 cooperates with the housing 80 to form the connector or slot channel 102 (FIG. 9) through which coating material flows to the slot outlet portion 104 (FIG. 3) of the long thin outlet 88.

The deflector 82 (FIG. 3) has a rectangular end with a nonlinear edge portion 209. The edge portion 209 cooperates with the linear inner side surface 156 of the right major side wall 148 of the housing 80 to define the long thin outlet 88. The nonlinear edge portion 209 on the deflector 82 has linear segments 210 and 211 which extend parallel to the inner side surface 156 of the right major side wall 148 of the housing 80 to partially define the upper and lower channel outlet portions 96 and 98 at opposite ends of the long thin outlet 88. In addition, the nonlinear edge portion 209 on the deflector 82 has sloping side segments 212 and 213 which further define the upper and lower channel outlet portions 96 and 98. The channel outlet portions 96 and 98 are disposed at the outlet ends of the upper and lower channels 92 and 94 (FIG. 9).

The nonlinear edge portion 209 (FIG. 3) on the deflector 82 has a linear segment 214. The linear segment 214 extends between the sloping side segments 212 and 213. The sloping side segments 212 and 213 provide a transition between the slot outlet portion 104 and the channel outlet portions 96 and 98. The linear segment 214 extends parallel to the inner side surface 156 of the right major side wall 148 of the housing 80. The linear segment 214 on the deflector 82 cooperates with the inner side surface 156 on the right major side wall of the housing 80 to define the slot outlet portion 104.

Figure 9:
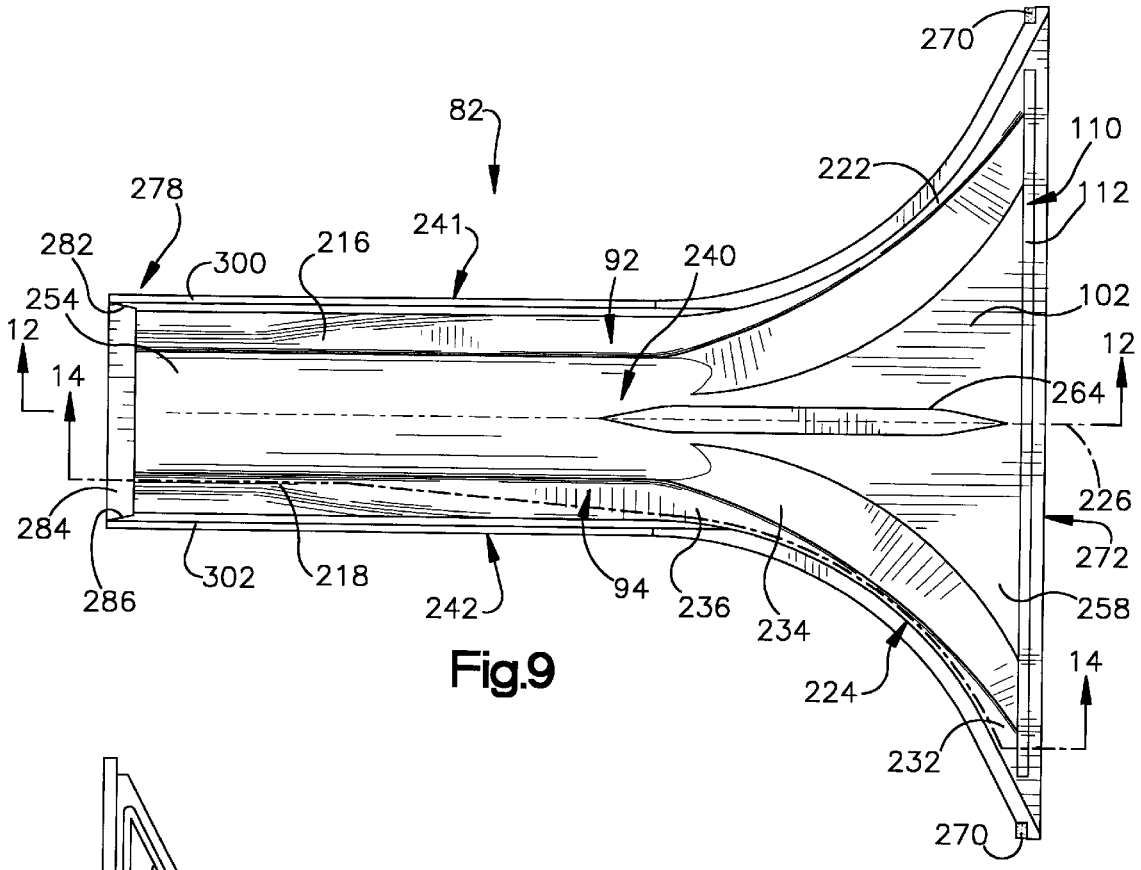
FIG. 9 is a top plan view, taken generally along the line 9—9 of FIG. 2, illustrating a deflector which is received in the housing of the spray head.
Figure 10:
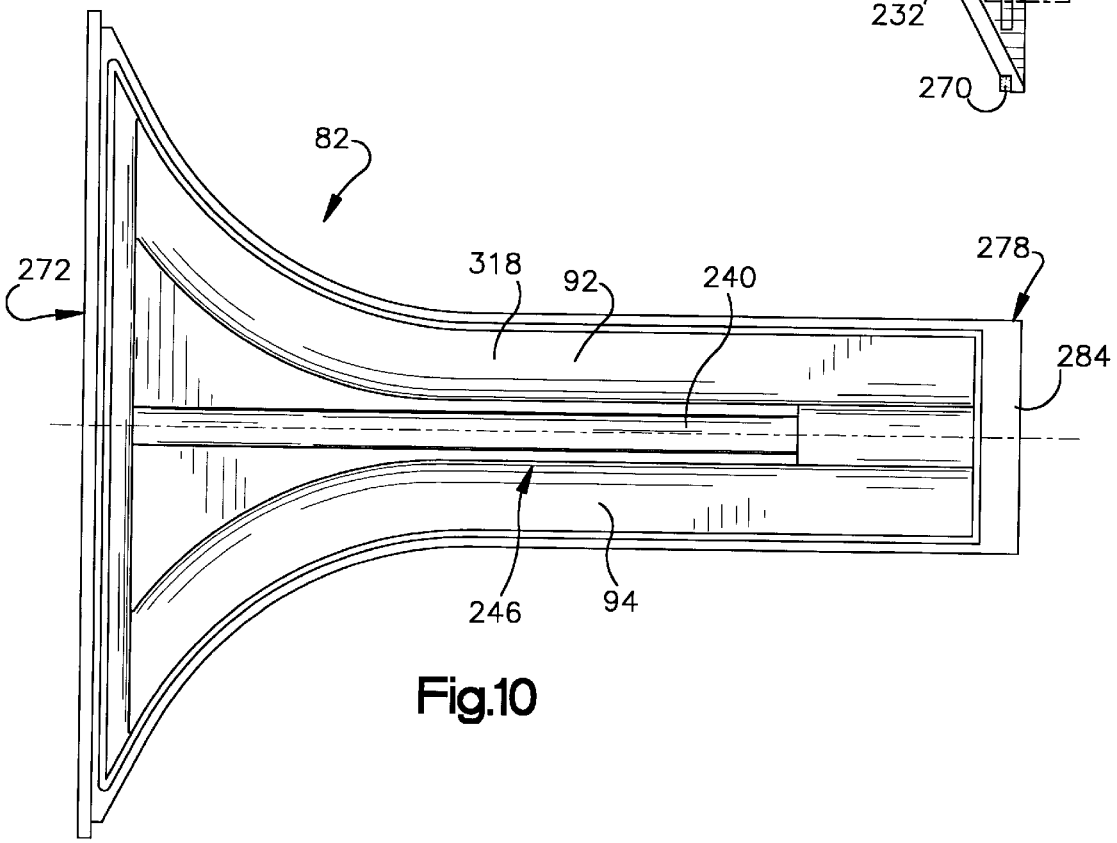
FIG. 10 is a bottom plan view, taken generally along the line 10—10 of FIG. 2, of the deflector with a bottom panel and a seal removed.

The slot outlet portion 104 is disposed at the outlet end of the slot channel 102 (FIG. 9). The upper and lower channel outlet portions 96 and 98 (FIG. 3) have a greater width, as measured in a direction perpendicular to the inner side surface 156 of the right major side wall 148 of the housing 80, than the slot outlet portion 104. The distance from the inner side surface 156 on the right major side wall 148 to the linear segment 210 of edge portion 209 of the deflector 82 is more than twice as great as the distance from the inner side surface 156 on the right major side wall to the linear segment 214. The lower channel outlet portion 98 is the same size as the upper channel outlet portion 96 of the long thin outlet 88. Since the upper and lower channel outlet portions 96 and 98 are more than twice as wide as the slot outlet portion 104 of the linear outlet 88, coating material is conducted at a greater flow rate through the upper and lower channel outlet portions 96 and 98 of the long thin outlet 88 than through the slot outlet portion 104.

In one specific embodiment of the spray head 34, the upper and lower channel outlet portions 96 and 98 had a width of approximately 0.133 inches. The slot outlet portion had a width of 0.035 inches. In this embodiment of the invention the long thin outlet 88 had a length of approximately 3.374 inches. It should be understood that the foregoing specific dimensions for the widths and length of the outlet 88 have been set forth herein merely for purposes of illustration. It is contemplated that the outlet 88 can and will be constructed with many different dimensions.

The flow divider 194 (FIG. 6) in the housing 80 directs the flow of air entrained coating material (powder) from the inlet passage 134 into the upper channel 92 and the lower channel 94. The upper and lower channels 92 and 94 are primarily defined by the deflector 82 (FIG. 9). The flat inner side surface 156 on the right major side wall 148 (FIGS. 5 and 8) of the housing 80 cooperates with the deflector 82 to further define the upper and lower channels 92 and 94.

The upper and lower channels 92 and 94 (FIG. 9) have parallel linear inlet portions 216 and 218. The linear configuration of the inlet portions 216 and 218 of the upper and lower channels 92 and 94 is effective to straighten the flow of coating material as it moves along the deflector 82. The linear inlet portions 216 and 218 of the upper and lower channels 92 and 94 have a constant maximum width throughout their length.

The depth of the linear inlet portions 216 and 218 of the upper and lower channels 92 and 94 decreases in the direction of flow of coating material through the channels. This results in the volumetric density of the flow of air entrained coating material (powder) increasing as the coating material flows rightward (as viewed in FIG. 9) along the linear portions 216 and 218 of the upper and lower channels 92 and 94.

In addition to the linear inlet portions 216 and 218, the upper and lower channels 92 and 94 have arcuate outlet portions 222 and 224 (FIG. 9). The outlet portions 222 and 224 diverge from a longitudinal central axis 226 of the deflector 82. The arcuate outlet portions 222 and 224 of the upper and lower channels 92 and 94 decrease in depth and increase in width as they extend downstream from the linear inlet portions 216 and 218 of the upper and lower channels 92 and 94. By shaping the arcuate outlet portions 222 and 224 of the upper and lower channels 92 and 94, the rate and direction of flow of coating material from the upper and lower channel outlet portions 96 and 98 (FIG. 3) of the long thin outlet 88 can be controlled.

The arcuately curving configuration of the outlet portion 222 (FIG. 9) of the upper channel 92 directs the flow of coating material from the upper channel upward away from the central axis 226 of the deflector 82. Similarly, the arcuately curving configuration of the outlet portion 224 of the lower channel 94 directs the flow from the lower channel 94 downward away from the central axis 226 of the deflector 82. The diverging flows of coating material from the outlet portions 222 and 224 of the upper and lower channels 92 and 94 results in a fan-like spray of coating material from the spray head 34.

Figure 13:
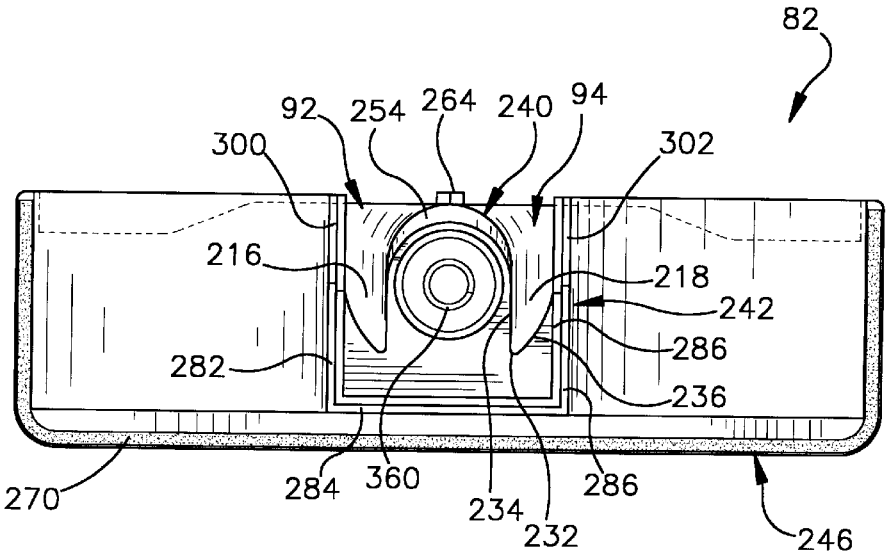
FIG. 13 is an end view, taken generally along the line 13—13 of FIG. 12, illustrating the relationship of a pair of coating material flow channels to a central portion of the deflector.

The linear inlet portion 218 of the lower channel 94 has an arcuate bottom surface 232 (FIG. 13). The inlet portion 218 of the lower channel 94 has side surfaces 234 and 236 which extend from the bottom surface 232. The inner side surface 234 is disposed on a linear central portion 240 of the deflector 82. The side surface 236 is disposed on a lower side wall 242 (FIGS. 9 and 13) of the deflector 82.

The cross sectional configuration of the linear inlet portion 218 of the lower channel 94 remains substantially constant throughout the length of the linear inlet portion 218 of the lower channel 94. However, the bottom surface 232 of the lower channel 94 slopes upward (as viewed in FIG. 14) from the inlet to the lower channel. Therefore, the depth of the lower channel 94 decreases in the direction of flow of coating material.

When the spray head 34 is in the orientation shown in FIG. 1. A bottom side 246 (FIGS. 11-14) of the deflector is in a vertical orientation. The bottom side 246 of the deflector 82 is disposed in engagement with the inner side surface 154 on the left (as viewed by an operator) major side wall 146 of the housing 80 (FIGS. 4 and 8). Since the bottom surface 232 of the lower channel 94 (FIG. 14) extends at an acute angle to the bottom side 246 of the deflector 82, the depth of the lower channel 94 continuously decreases as the coating material flows along the channel.

The distance between the opposite side surfaces 234 and 236 (FIG. 13) of the lower channel 94 remains substantially constant throughout the length of the linear inlet portion 218 (FIG. 9) of the lower channel. Therefore, as the coating material moves along the linear inlet portion 218 of the lower channel 94 towards the arcuate outlet portion 224 of the lower channel, the cross sectional area of the lower channel decreases. This results in an increase in the volumetric density in the flow of air entrained powder through the lower channel 94 as the flow of air entrained powder approaches the arcuate outlet portion 224 of the lower channel.

As the lower channel 94 enters the arcuate outlet portion 224, the width of the lower channel increases. Thus, the side surfaces 234 and 236 (FIG. 13) of the lower channel 94 diverge in the arcuate outlet portion 224 (FIG. 9) of the lower channel. At the same time, the depth of the lower channel continues to decrease in the arcuate outlet portion 224. This results in a widening and thinning of the stream of air entrained coating material as it moves through the arcuate outlet portion 224.

When the deflector 82 is in the vertical orientation shown in FIGS. 1 and 9, the lower side surface 236 and the upper side surface 234 in the arcuate outlet portion 224 curve downward. This results in a downward component of velocity being imparted to each particle of powder moving through the arcuate outlet portion of the lower channel 94. Since the depth of the lower channel is continuously decreasing, the distance between the flat inner side surface 156 (FIG. 8) on the housing 80 and the bottom 232 of the outlet portion 224 is decreasing. This results in a thin fan-like flow of coating material (powder) being conducted through the outlet portion 224 of the lower channel 94 to and directed downward from the lower channel outlet portion 98 (FIG. 3) of the long thin outlet 88.

The upper channel 92 (FIG. 9) has the same configuration as the lower channel 94. However, the upper channel 92 diverges upward (as viewed in FIGS. 1 and 9) away from the longitudinal central axis 226 of the deflector 82. This results in a thin fan-like flow of powder being directed upward toward the upper channel outlet portion 96 of the long thin outlet 88 by the upper channel 92 (FIGS. 3 and 9).

The downwardly directed flow of air entrained powder from the lower channel 94 continues to diverge from the upwardly directed flow of air entrained powder from the upper channel 92 as the flow of powder moves away from the spray head 34. This results in the powder being applied to an object in a relatively wide band. The wide band enables a substantial surface area on the object to be covered by the flow of coating material from the spray head 34. Although the long thin outlet 88 is described herein as being in a vertical orientation, it is contemplated that the spray head 34 could be used with the outlet 88 in a different orientation.

The relatively thin flat connector or slot channel 102 extends between the upper and lower channels 92 and 94 (FIG. 9). As the upper and lower channels 92 and 94 diverge at the arcuate outlet portions 222 and 224 of the channels, the width of the slot channel 102 increases in a direction transverse to the direction of flow of coating material through the slot channel.

When coating material is flowing through the linear inlet portions 216 and 218 of the upper and lower channels 92 and 94, the slot channel 102 is defined by an arcuate, that is semi-circular, side surface 254 (FIG. 13) of the central portion 240. The side surface 254 of the central portion 240 extends tangentially to the side surface 234 of the lower channel 94. Similarly, the side surface 254 on the central portion 240 extends tangentially to a side surface of the upper channel 92 in the linear inlet portion 216 of the upper channel 92. Throughout the linear inlet portions 216 and 218 of the upper and lower channels 92 and 94, the slot channel 102 has a flat side surface defined by the flat inner side surface 156 of the right major side wall 148 (FIG. 5) of the housing 80.

As the upper and lower channels 92 and 94 progress from the linear inlet portions 216 and 218 into the arcuate outlet portions 222 and 224, a flat side surface 258 begins to form on the deflector 82 (FIG. 9). The flat side surface 258 extends generally parallel to the flat inner side surface 156 on the right major side wall 148 of the housing 80. The flat side surface 258 has a generally triangular configuration with an apex at the junction between the linear inlet portions 216 and 218 of the upper and lower channels 92 and 94 and the arcuate outlet portions 222 and 224 of the upper and lower channels. As the arcuate outlet portions 222 and 224 of the upper and lower channels 92 and 94 diverge, the width of the flat surface 258 increases.

As the width of the flat surface 258 increases, the width of the slot channel 102 formed between the flat surface 258 and the inner side surface 156 on the right (as viewed by an operator) major side wall 148 (FIG. 8) of the housing 80 increases. As the width of the slot channel 102 (FIG. 9) increases, the velocity of the particles of powder flowing through the channel tends to decrease. The slot channel 102 continues to increase in width until it reaches the slot outlet portion 104 (FIG. 3) of the long thin outlet 88. The flow of coating material from the slot channel 102 through the slot outlet portion 104 of the long thin outlet 88 has a thin sheet-like configuration. The flow restriction provided by the slot channel 102 results in coating material tending to flow through the upper and lower channels 92 and 94.

Figure 14:
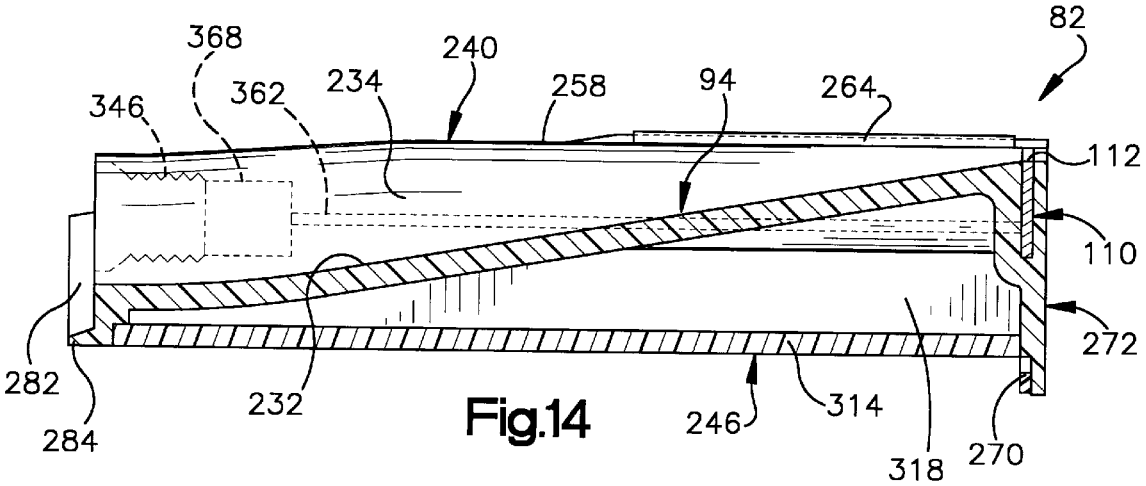
FIG. 14 is a sectional view, taken generally along the line 14—14 of FIG. 9, further illustrating the construction of one of the coating material flow channels.

A long thin rib 264 projects from the flat surface 258 (FIGS. 9 and 14). The rib 264 engages the flat inner side surface 156 on the right (as viewed by an operator) major side wall 148 (FIG. 3) of the housing 80. This enables the rib 264 to maintain a desired minimum spacing between the inner side surface 156 of the housing and the flat surface 258 on the deflector 82. In the illustrated embodiment of the invention, the rib 264 projects 0.035 inches from the flat surface 258. Of course, the rib 264 could project a different distance from the flat surface 258 if desired. In the absence of the rib 264, the right major side wall 148 of the housing 80 could be deflected inward toward the flat surface 258 on the deflector 82 in such a manner as to restrict the slot channel 102.

The rib 264 is aligned with the longitudinal central axis 226 of the deflector 82. This enables the rib 264 to align the flow of coating material through the slot channel 102 in an orientation perpendicular to the slot outlet portion 104 of the long thin outlet 88.

The spray head 34 is assembled by inserting the deflector 82 (FIG. 2) into the housing 80. When the deflector 82 is positioned in the housing 80, it is desirable to block any leakage of powder between the deflector and the housing. In order to block leakage of powder between the deflector and the housing, tongue and groove joints are provided between the deflector and the housing. In addition, a seal 270 (FIGS. 11 and 13) is provided between rectangular outer end portion 272 of the deflector 82 and an outer end portion 274 (FIG. 2) of the housing 80.

Figure 15:
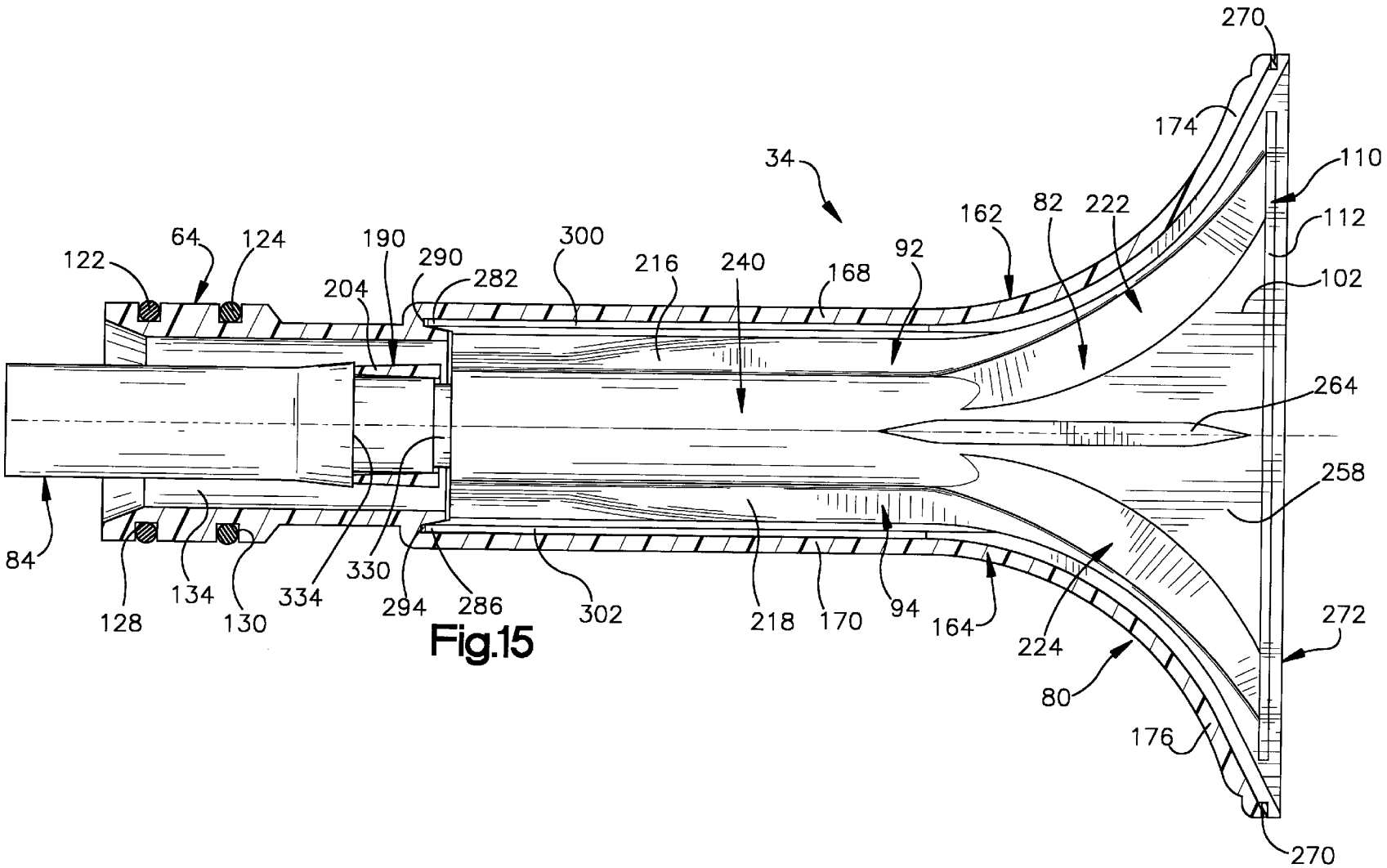
FIG. 15 is a sectional plan view of the portion of the housing illustrated in FIG. 4 in association with the deflector of FIG. 9 and illustrating the manner in which a wear tube interconnects the deflector and the housing.

To seal a joint between an inner end portion 278 (FIG. 9) of the deflector 82 and the housing 80, the inner end portion 278 of the deflector has flanges 282, 284 and 286 (FIG. 13) arranged in a generally U-shaped array. The housing 80 has a plurality of grooves 290, 292 and 294 (FIG. 8) arranged in a generally U-shaped array. The grooves 290, 292 and 294 are disposed on the walls of the housing 80 and face toward the open outer end of housing 80. When the deflector 82 is inserted into the housing 80, the flange 286 (FIG. 13) is inserted into the groove 294 (FIG. 8), the flange 284 is inserted into the groove 292 and the flange 282 is inserted into the groove 290 (FIG. 15).

In addition to the tongue and groove seals provided between the inner end portion 278 of the deflector 82 and the support section 190 of the housing 80, tongue and groove seals are provided between upper and lower side walls 241 and 242 (FIG. 9) of the deflector 82 and the housing 80. The linear portion of the deflector 82 is provided with linear flanges 300 and 302 (FIGS. 9 and 13). The flanges 300 and 302 engage linear grooves 306 and 308 (FIGS. 5 and 8) along the upper and lower side walls 162 and 164 of the housing 80.

Figure 11:
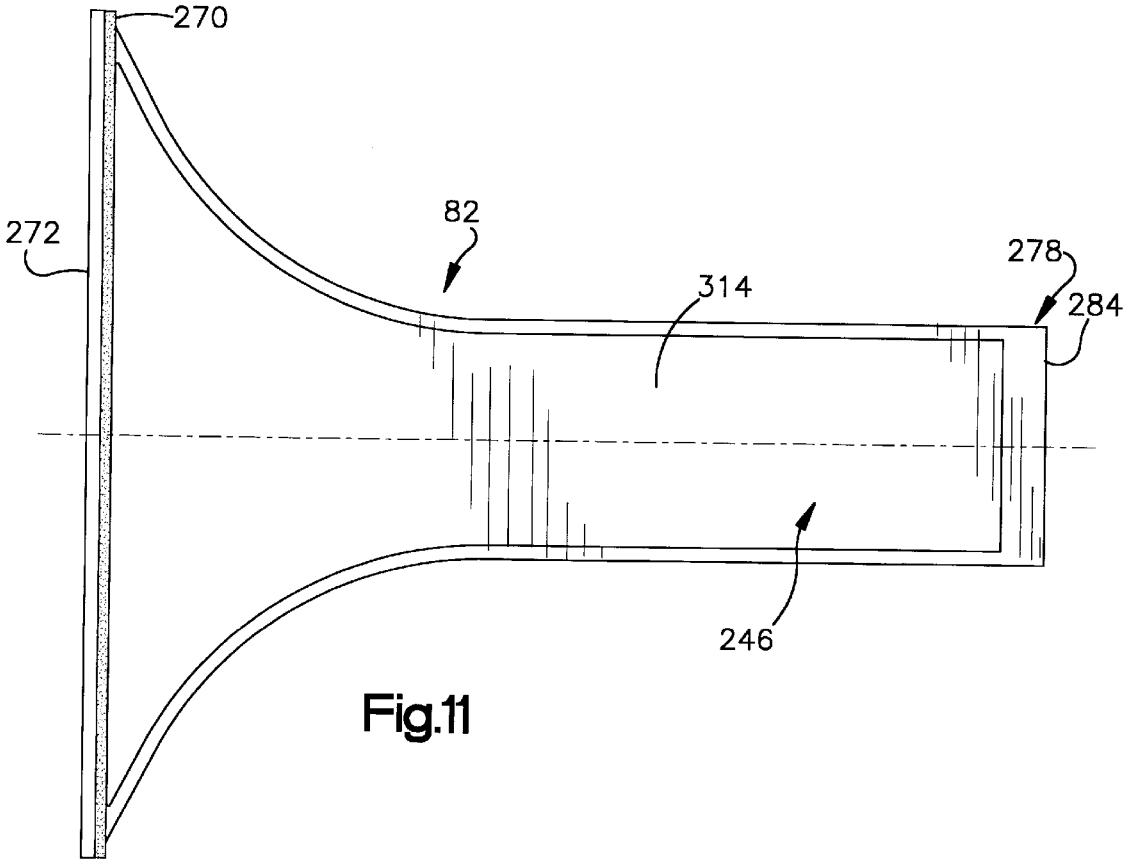
FIG. 11 is a bottom plan view, generally similar to FIG. 10 of the deflector, with the bottom panel and seal in place.
Figure 12:
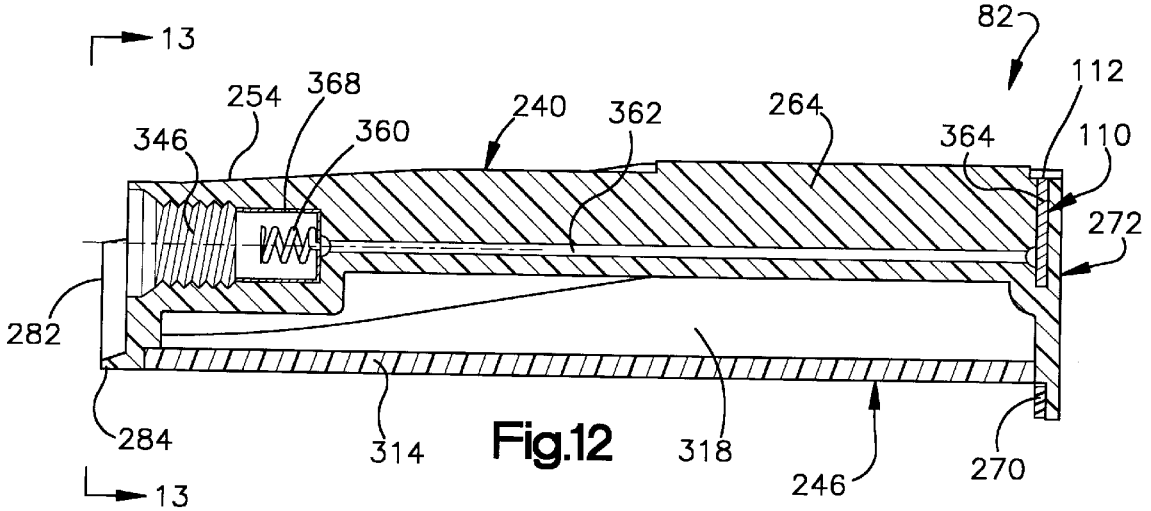
FIG. 12 is a sectional view, taken generally along the line 12—12 of FIG. 9, further illustrating the construction of the deflector.

In addition to providing the tongue and groove seals and the polymeric or rubber seal 270 between the housing 80 and deflector 82, the lower side 246 (FIG. 10) of the deflector 82 is sealed by a cover plate 314 (FIG. 11). Prior to positioning of the cover plate 314 on the lower side 246 of the deflector 82, there is an open cavity 318 (FIG. 10) which extends along the central portion 240 and the upper and lower channels 92 and 94. The cavity 318 (FIG. 10) is sealed by the cover plate 314 (FIG. 11). The cover plate 314 prevents powder from accumulating in the lower side of the deflector 82 after extensive use of the deflector.

Interconnection Between Housing and Deflector

Figure 2:
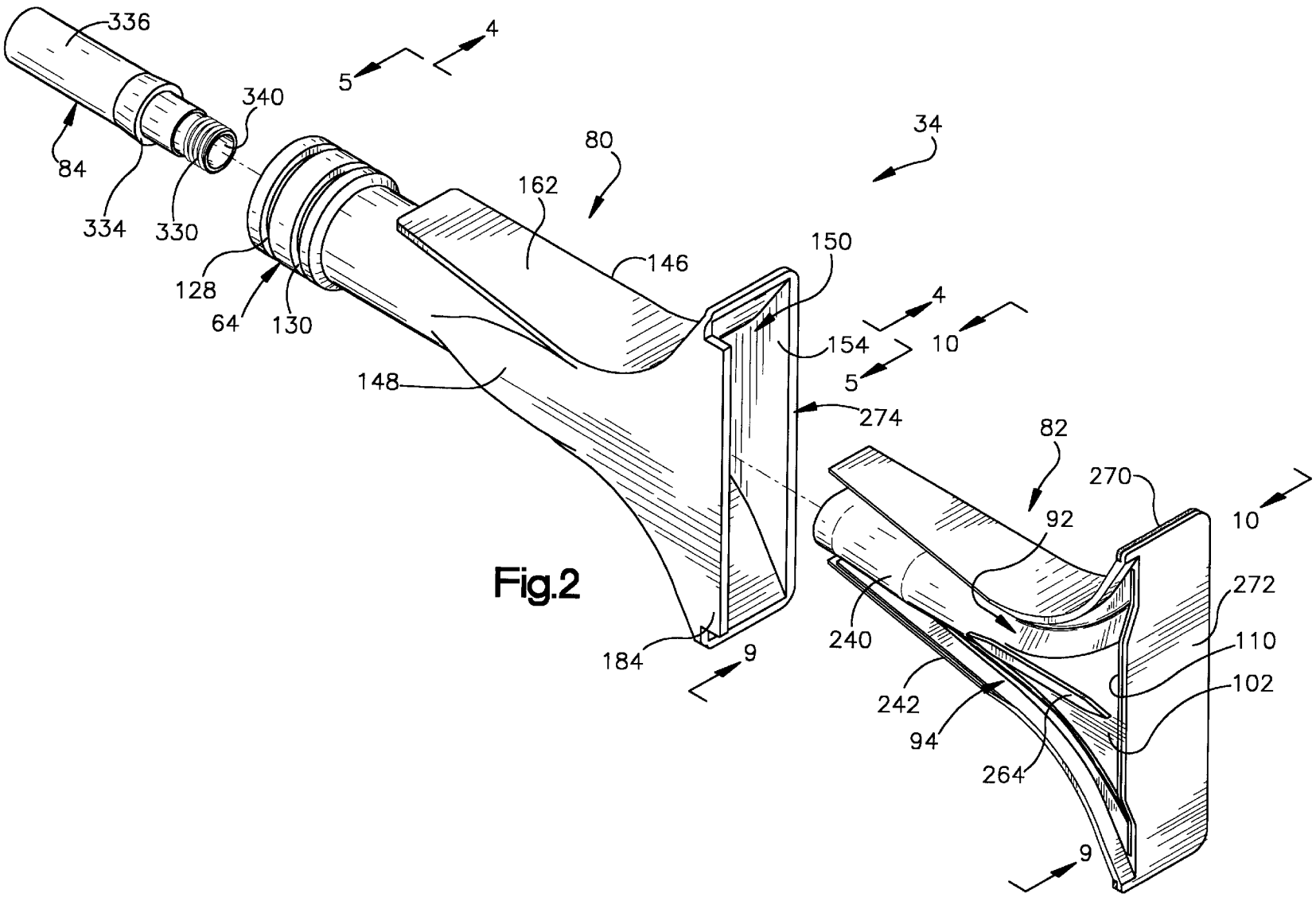
FIG. 2 is an exploded pictorial illustration of an improved spray head used in the apparatus of FIG. 1 to direct a flow of coating material toward the object.

The housing 80 and deflector 82 are releasably interconnected by the wear tube 84 (FIGS. 2 and 15). The wear tube 84 includes a threaded end portion 330 (FIG. 2) and a radially outwardly projecting shoulder 334. Upstream from the shoulder 334 is a cylindrical main section 336 of the wear tube 84. A cylindrical passage 340 extends axially through the wear tube 84. The wear tube 84 can be formed of any polymeric material having good wear characteristics.

When the deflector 82 and housing 80 are to be interconnected, the deflector is telescopically inserted into the housing through the open end 150 of the deflector receiving cavity 138 (FIGS. 2 and 4). As the deflector 82 is inserted into the housing, the flanges 300 and 302 (FIG. 9) on the side wall of the deflector move into engagement with the grooves 306 and 308 on the housing (FIGS. 5 and 8). Continued movement of the deflector 82 into the housing 80 moves the flanges 282, 284 and 286 (FIG. 13) on the inner end portion 278 of the deflector 82 into engagement with the grooves 290, 292 and 294 (FIG. 8) as described above.

Once the deflector 82 has been positioned in the housing 80, the wear tube 84 is inserted through the inlet end portion 64 of the housing. The externally threaded leading end portion 330 of the wear tube 84 moves through the opening 208 in the support section 190 (FIG. 6) into engagement with an internally threaded opening 346 (FIG. 12) in the inner end portion 278 of the deflector 82. The wear tube 336 is then rotated about its central axis.

The internal threads in the opening 346 on the deflector 82 and the external threads on the end portion 330 of the wear tube 84 cause the deflector 82 to be pulled into the housing 80 (FIG. 15). As this occurs, the seal 270 (FIG. 13) on the rectangular outer end portion 272 of the deflector 82 is pressed against the outer end portion 274 of the housing 80. This seals the open end 150 of the deflector receiving cavity 138 in the housing 80.

When the spray head 34 is inserted into the housing assembly 32 (FIG. 1) of the spray gun 30, a portion of the electrode assembly 68 is telescopically inserted into the wear tube 84. This enables the wear tube to protect the enclosed portion of the electrode assembly 68 against abrasion by the flow of powder from the delivery conduit 36 during use of the spray gun 30. The deflector 82 can be easily replaced by merely sliding the spray head 34 out of the housing assembly 32 and loosening wear tube 84.

Electrode Assembly

The electrode assembly 68 (FIG. 1) extends between the voltage multiplier 72 and the electrode element 110 (FIGS. 16 and 17) at the outer end portion of the deflector 82. The portion of the electrode assembly 68 disposed in the housing assembly 32 (FIG. 1) of the spray gun 30 includes a resistor stack 354 which is connected with the voltage multiplier 72 by a spring 356. Thus, the relatively high output voltage (100 kv) from the voltage multiplier 72 is conducted through the spring 356 to the resistor stack 354.

Figure 16:
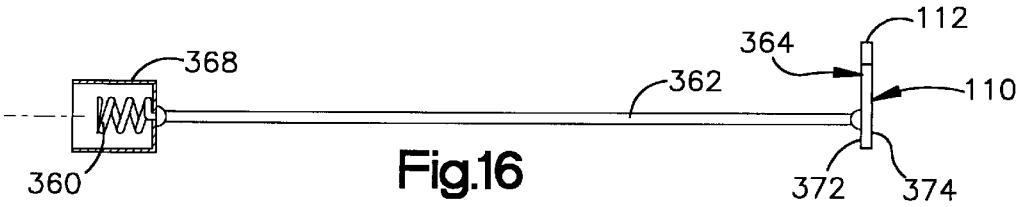
FIG. 16 is a sectional view of a portion of an electrode assembly used in the apparatus of FIG. 1, the illustrated portion of the electrode assembly being embedded in the deflector in the manner illustrated in FIG. 12.

At the right end (as viewed in FIG. 1) of the resistor stack 354 is a pin (not shown) which is in electrical contact with a metal spiral spring 360 (FIG. 16). The spiral spring 360 is integrally formed as one piece with a long thin cylindrical metal conductor rod 362. The conductor rod 362 is soldered to a metal plate 364 (FIGS. 16 and 17) which forms the electrode element 110. The spiral spring 360 is enclosed by a cylindrical metal cap or sleeve 368 and soldered to it. The conductor rod 362 and plate 364 are formed of stainless steel. The cap 368 is formed of brass.

The electrode element 110 is formed by the flat metal plate 364. The flat metal plate 364 has parallel major side surfaces 372 and 374 (FIG. 16). The metal plate 364 has minor side surfaces which extend between the parallel major side surfaces 372 and 374. The long thin surface area 112 (FIG. 17) is one of the minor side surfaces of the plate 364.

In one embodiment of the invention, the flat metal plate was formed of 20 gauge stainless steel sheet and the ling thin surface area 112 had a width of approximately 0.0355 inches and a length of approximately 2.944 inches. Of course, the surface area 112 could have dimensions which are different than these specific dimensions.

Figure 17:
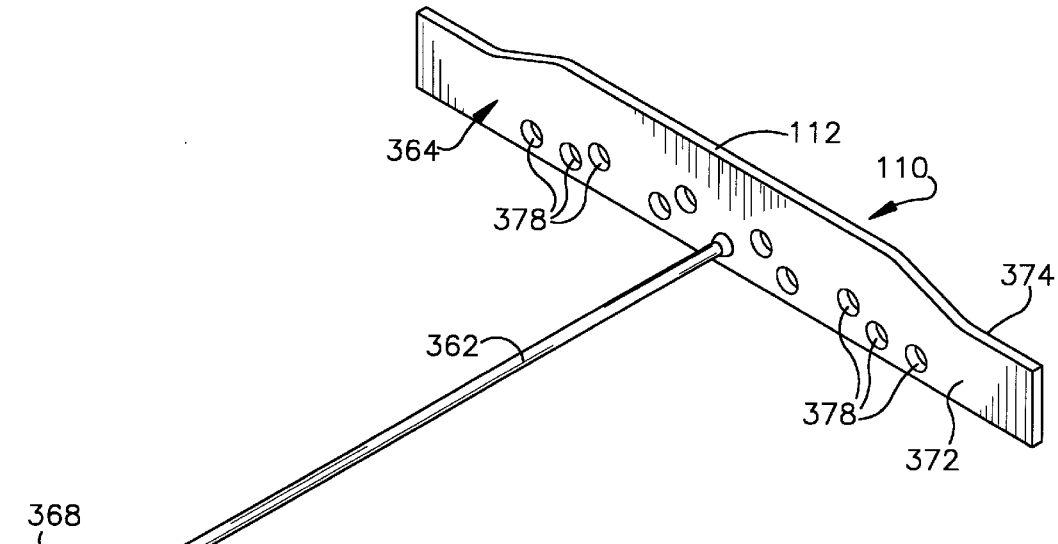
FIG. 17 is a pictorial illustration further depicting the construction of the portion of the electrode assembly illustrated in FIG. 16.

When the deflector 82 is to be formed, the assembly shown in FIG. 17 is inserted into the mold. At this time, the plate 364 has a substantially greater upward (as viewed in FIG. 16) extent which is inserted into a slot in the mold to position the electrode in the mold. In addition, a locating pin is inserted into the metal cap 368 to position the conductor wire 362 in the mold.

Liquid polymeric material which forms the deflector 82 is then injected into the mold around the conductor 362 and the plate 364 as well as the outside at cap 368. As this is done, the liquid polymeric insulating material flows through the circular holes or openings 378 in the plate 364. The deflector 82 could be formed of many different electrically insulating polymeric materials.

Once the liquid polymeric material has solidified to form the deflector 82, the plate 364 is cut away to remove the excess upwardly extending material. As this is done, the long thin side surface area 112 is formed on the plate 364 in a coplanar relationship with the flat side surface 258 for the slot channel 102 (FIGS. 9, 12, and 14) and the bottom surfaces 232 of the channels 92 and 94. The solidified polymeric material in the openings 378 (FIG. 17) hold the plate 364 in a desired position in the deflector 82. The major side surfaces 372 and 374 of the plate 364 extend generally parallel to the flat outer end portion 272 of the deflector 82.

Deflector—Second Embodiment

In the embodiment of the deflector illustrated in FIGS. 9–15, the upper and lower channels 92 and 94 have inner side surfaces 234 which slope so that the upper and lower channels become shallower toward the arcuate outlet portions 222 and 224 of the deflector 82. This slope results in the spray head 34 producing a 300 mm (12 inches) nominal effective pattern width for coating an object having a relatively wide flat surface. When it is desired to increase the nominal effective pattern width from 300 mm (12 inches) to 600 mm (24 inches) the deflector illustrated in FIG. 18 is substituted for the deflector 82 illustrated in FIGS. 9–15.

Figure 18:
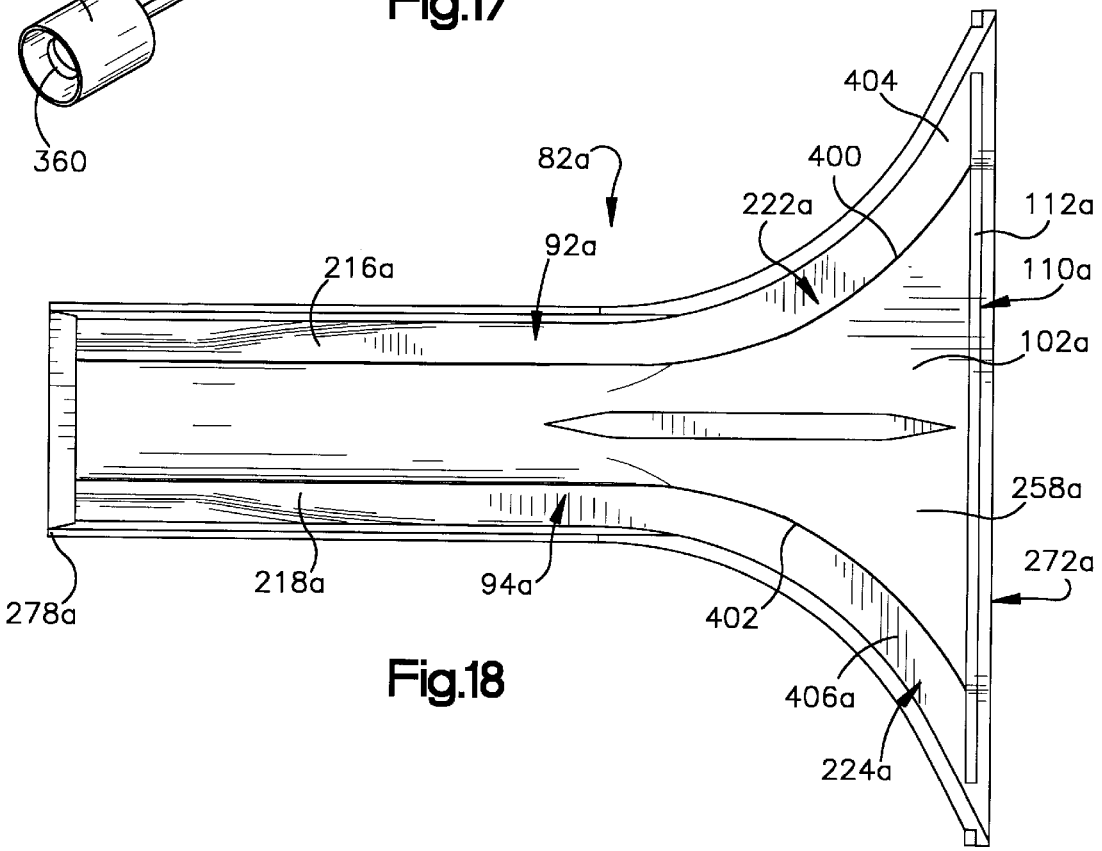
FIG. 18 is a top plan view, generally similar to FIG. 9, of an alternative embodiment of the deflector.

Since the deflector of FIG. 18 has the same general construction as the deflector of FIGS. 9-15, similar numerals will be utilized to designate similar components of the deflector of FIG. 18. The suffix letter "a" being added to the numerals of FIG. 18 to avoid confusion. It should be understood that the deflector of FIG. 18 cooperates with a housing 80 and wear tube 84 in the same manner as does the deflector 82. It should also be understood that the deflector of FIG. 18 has an electrode element with the same construction as the electrode element of FIGS. 16 and 17.

The deflector 82*a* (FIG. 18) has upper and lower channels 92*a* and 94*a* which extend between an inner end portion 278*a* of the deflector 82*a* and an outer end portion 272*a* of the deflector 82*a*. The outer end portion 272*a* of the deflector 82*a* cooperates with a housing, such as the housing 80 of FIGS. 2 and 3, to define a long thin outlet corresponding to the long thin outlet 88 of FIG. 3.

The upper and lower channels 92*a* and 94*a* (FIG. 18) have linear inlet portions 216*a* and 218*a* with the same construction as the linear inlet portions 216 and 218 (FIG. 9) of the deflector 82 (FIG. 9). However, the upper and lower channels 92*a* and 94*a* of the deflector 82*a* (FIG. 18) have arcuate outlet portions 222*a* and 224*a* which are narrower than the arcuate outlet portions 222 and 224 of the deflector 82 of FIG. 9.

Although the arcuate outlet portions 222*a* and 224*a* (FIG. 18) of the deflector 82*a* are narrower than the arcuate outlet portions 222 and 224 of the deflector 82, the arcuate outlet portions 222*a* and 224*a* have substantially the same depth as the arcuate outlet portions 222 and 224 of the deflector 82. The relatively narrow cross sectional area of the arcuate outlet portions 222*a* and 224*a* of the deflector 82*a* result in the particles of coating material (powder) moving through the arcuate outlet portions 222*a* and 224*a* of the deflector 82*a* having a greater velocity than the particles of coating material moving through the arcuate outlet portions 222 and 224 of the deflector 82 for the same overall coating material flow rate which produces a wider spray pattern.

In addition to being narrower, the arcuate outlet portions 222*a* and 224*a* of the deflector 82*a* have inner side surfaces 400 and 402 which extend generally perpendicular to bottom surfaces 404 and 406 of the arcuate outlet portions 222*a* and 224*a*. This results in a slot channel 102*a* being partially defined by a relatively large flat surface 258*a* which extends between the arcuate outlet portions 222*a* and 224*a* of the upper and lower channels 92*a* and 94*a*. This results in the long thin outlet 88 (FIG. 3) having a relatively long slot outlet portion 104 and relatively narrow upper and lower outlet portions 96 and 98 when the deflector 82*a* (FIG. 18) is used with the housing 80. The result is that more of the powder is directed to the outer edges of the pattern than is the case with the FIG. 9 embodiment, and less powder flows through the center of the spray head.

The deflector 82*a* has an electrode element 110*a* with substantially the same construction as the electrode element 110 (FIGS. 16 and 17) used with the deflector 82. However, due to the different width of the arcuate outlet portions 222*a* and 224*a* of the deflector 82*a*, the surface 112*a* of the electrode element 110*a* which is coplanar with the flat surface 258*a* is modified compared to the surface 112 of the electrode 110 which is coplanar with the flat side surface 258 of the deflector 82 (FIG. 9).

Coating Application

Figure 19:
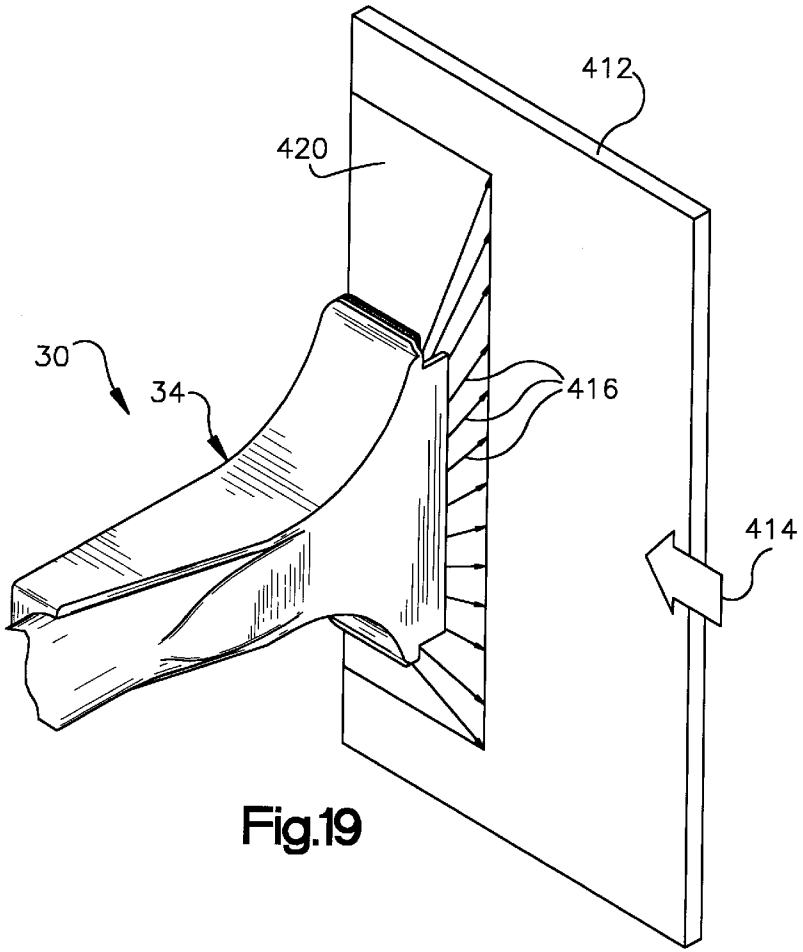
FIG. 19 is a schematic illustration depicting the manner in which coating material is applied to a flat object by the spray head of FIGS. 1 and 2.

The manner in which the spray head 36 is used to apply coating material to an object, such as a flat plate 412, is illustrated schematically in FIG. 19. In the illustrated embodiment of the invention, the spray gun 30 is stationary and the flat plate 412 is moved leftward (as viewed in FIG. 19) past the spray gun in the manner indicated by an arrow 414 in FIG. 19. The spray head 34 is positioned ten (10) inches from the flat thin plate 412. As the flat plate 412 moves past the spray gun 30, a flat, thin fan-like spray 416 of coating material is directed from the spray head 34 onto the object 412. This results in the application of a relatively wide pattern or band 420 of coating material to the flat plate 412.

Figure 20:
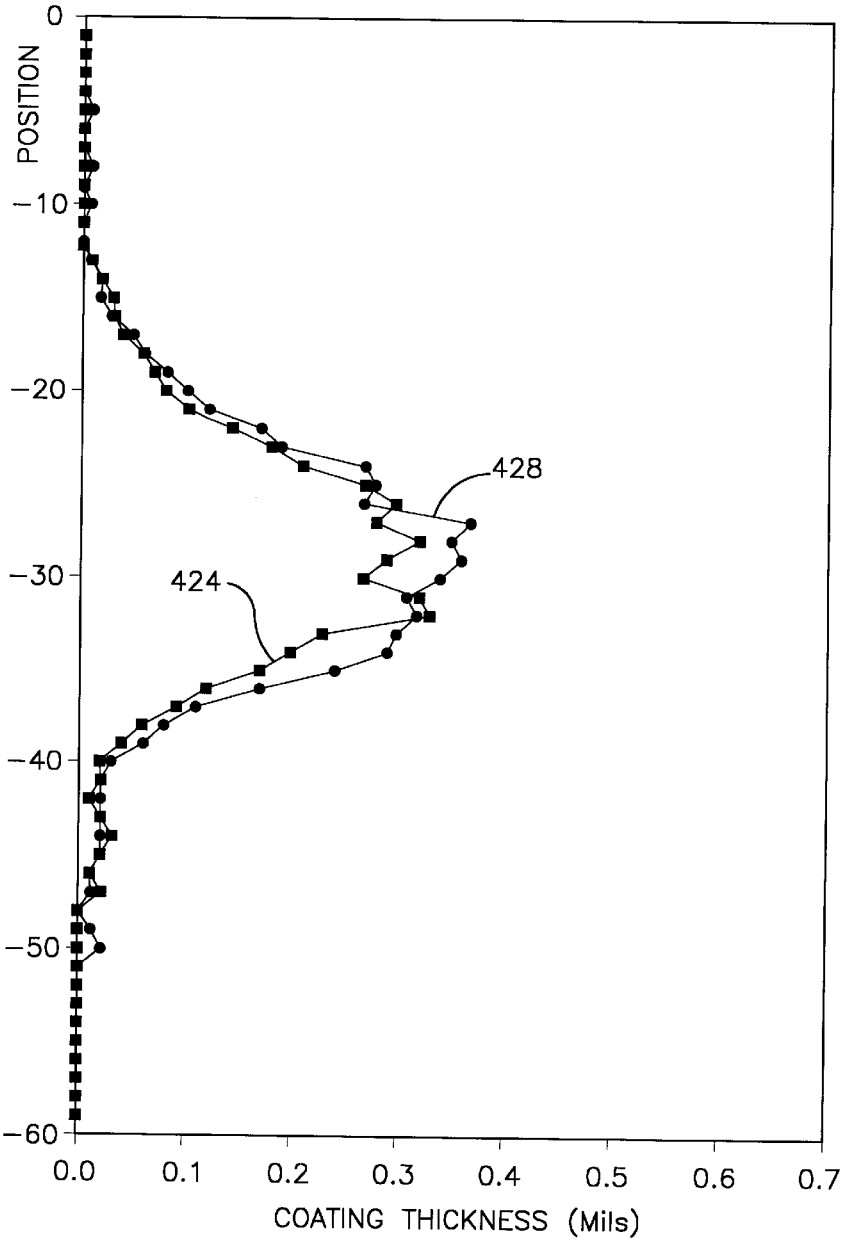
FIG. 20 is a graph depicting the distribution of coating material on the flat object of FIG. 19 when the spray head includes the deflector of FIG. 9.

Results which were obtained by using the spray gun 30 to apply coating material to a workpiece in a pattern having the configuration of the flat band 420 is illustrated by the graph of FIG. 20. A curve 424 illustrates the manner in which the coating thickness on the plate varies when the powder was applied at a relatively low flow rate of 150 grams/minute (20 lbs./hr). A second curve 428 illustrates the manner in which the coating thickness in the plate varies when there is a relatively high flow rate of 300 grams/minute (40 lbs./hr). During application of the spray patterns represented by the curves 424 and 428, the spray head 34 was spaced ten inches from the flat plate 412.

The maximum coating thickness which was obtained with the high flow rate was approximately 3.7 mils (0.0037 inches). The maximum coating thickness which was obtained at the low flow rate was approximately 3.3 mils (0.0033 inches). If the effective width of the pattern 420 represented by the curves 424 and 428 of FIG. 20 is considered as being one-half of the maximum thickness of the coating, the effective pattern width for the low flow rate curve 424 would be approximately 12.5 inches. The effective pattern width for the high flow rate curve 428 would be approximately 13 inches.

The average transfer efficiency of powder from the spray head 34 to the flat plate 412 (FIG. 19) was approximately 93.4% for the low flow rate, that is the flow rate represented by the curve 424 in FIG. 20. The transfer efficiency for the high flow rate, that is the flow rate represented by the curve 428 in FIG. 20, was approximately 89.7%. Thus, for the low flow rate, approximately 93.4% of the powder which was discharged from the spray head 34 adhered to the flat thin plate 412. For the high flow rate, approximately 89.7% of the powder which was discharged from the spray head 34 adhered to the flat plate 412. It should be understood that measurements of transfer efficiency have many different variables and are difficult to repeat. However, when the variables are maintained as constant as reasonably possible, transfer efficiency is important for comparing different spray heads.

Figure 21:
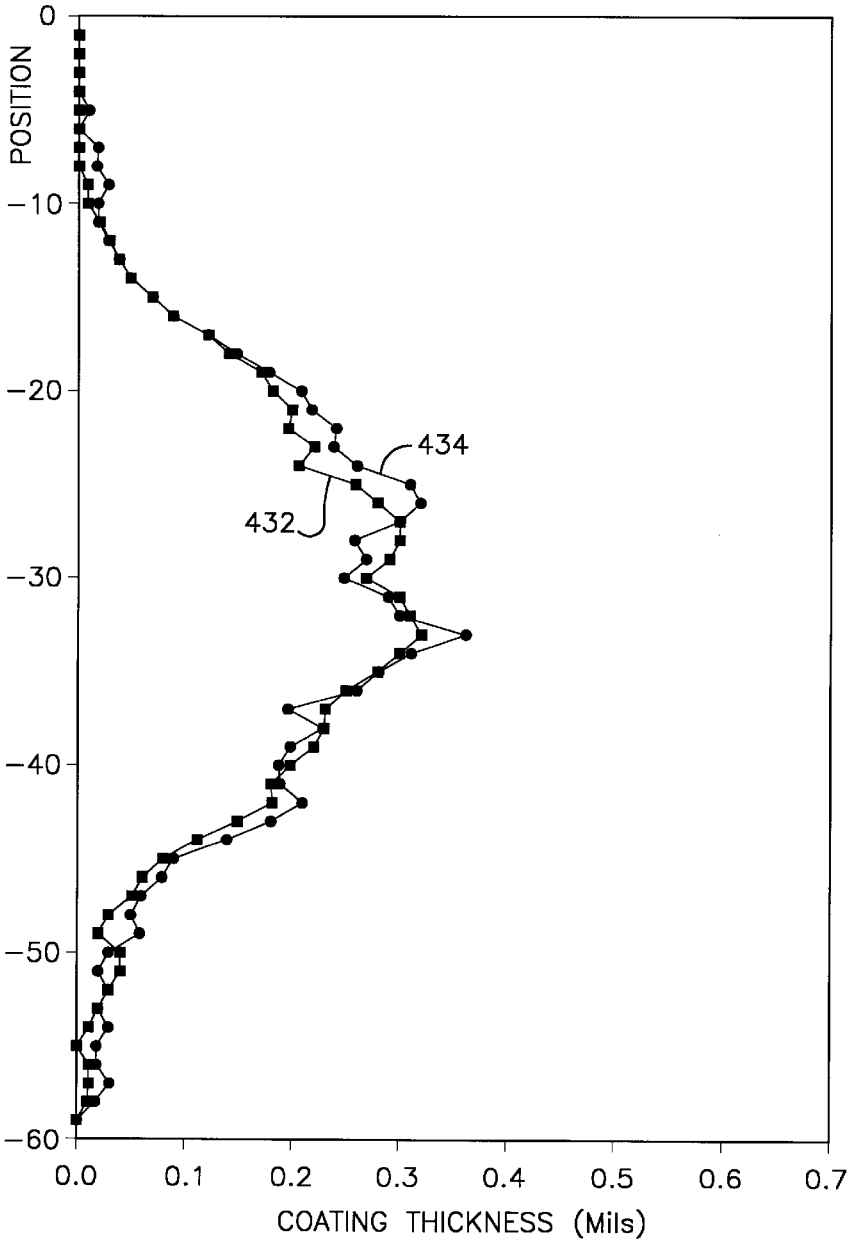
FIG. 21 is a graph illustrating the distribution of coating material on the flat object of FIG. 19 when the spray head includes the deflector of FIG. 18.

The curves 424 and 428 for the application of coating material to the flat plate 412 were obtained using the deflector 82 (FIG. 9) in association with the housing 80. The graph of FIG. 21 represents the pattern which was obtained when the deflector 82*a* (FIG. 18) was utilized in the housing 80 of the spray head 34. The effect of the relatively narrow arcuate outlet portion 222*a* and 224*a* of the deflector 82*a* can be seen in the relatively wide pattern which is obtained when the deflector 82*a* is used with the housing 80.

A curve 432 in FIG. 21 represents the pattern which was obtained when ferro powder was applied to the flat plate 412 with a spray head using the deflector 82*a* of FIG. 18 at a relatively low powder flow rate of 150 grams/minute (20 lbs./hr). The curve 434 in FIG. 21 represents the pattern which was obtained when a relatively high coating material (powder) flow rate of 300 grams/minute (40 lbs./hr) was discharged from the spray gun. During application of the spray patterns represented by the curves 432 and 434, the spray head 34 was spaced ten inches from the flat plate 412. It should be noted that the two curves 432 and 434 in FIG. 21 are very similar.

When the low flow rate represented by the curve 432 was utilized, the pattern had a maximum thickness of approximately 3.2 mils (0.0032 inches). If it is assumed that the effective width of the pattern is at one-half of the maximum thickness of the low flow rate pattern represented by the curve 432, the width of the pattern would be approximately 24 inches. The high flow rate pattern represented by the curve 434 in FIG. 21 had a maximum pattern thickness of approximately 3.6 mils (0.0036 inches). The effective pattern width for the high flow rate curve 434 was also approximately 24 inches. The effective width of the pattern applied to a workpiece, that is to the plate 412, is approximately twice as great when the deflector 82*a* is used as when the deflector 82 is used.

The transfer efficiency when the deflector 82*a* (FIG. 18) is used with the housing 80, is approximately 92.7% for the low flow rate represented by the curve 432 in FIG. 21. The transfer efficiency for the deflector 82*a* at the high flow rate represented by the curve 434 in FIG. 21 was approximately 89%.

When the deflector 82 (FIG. 9) is used in the spray head 36, a pattern width of approximately 12 inches is obtained whether the powder is conducted at the high flow rate or the low flow rate. When the deflector 82*a* is used in the spray head 36, a pattern width of approximately 24 inches is obtained whether the powder is applied at the high flow rate or the low flow.

The maximum pattern thickness for the low flow rate is approximately the same with either the deflector 82 or the deflector 82*a*. The maximum pattern thickness is thicker at the high flow rate than at the low flow rate when either the deflector 82 or the deflector 82*a* is used. However, for a given flow rate, approximately the same maximum pattern thickness is obtained with either of the two deflectors 82 or 82*a*.

Similarly, the coating material transfer efficiency for the two deflectors 82 and 82*a* are approximately the same at the low coating material flow rate. At the high coating material flow rate, the coating material transfer efficiency is less for both of the deflectors 82 and 82*a*. However, the deflectors 82 and 82*a* have approximately the same transfer efficiency when the coating material is applied at the high flow rate.

For comparison purposes, a pattern obtained by a known spray gun was compared with the patterns obtained with the spray gun 30. The known spray gun was a "Versa-Spray II" (trademark) spray gun with a four mm (millimeter) flat spray nozzle. This known spray gun is commercially available from Nordson Corporation, Powder Systems Group, Amherst, Ohio 44001.

Figure 22:
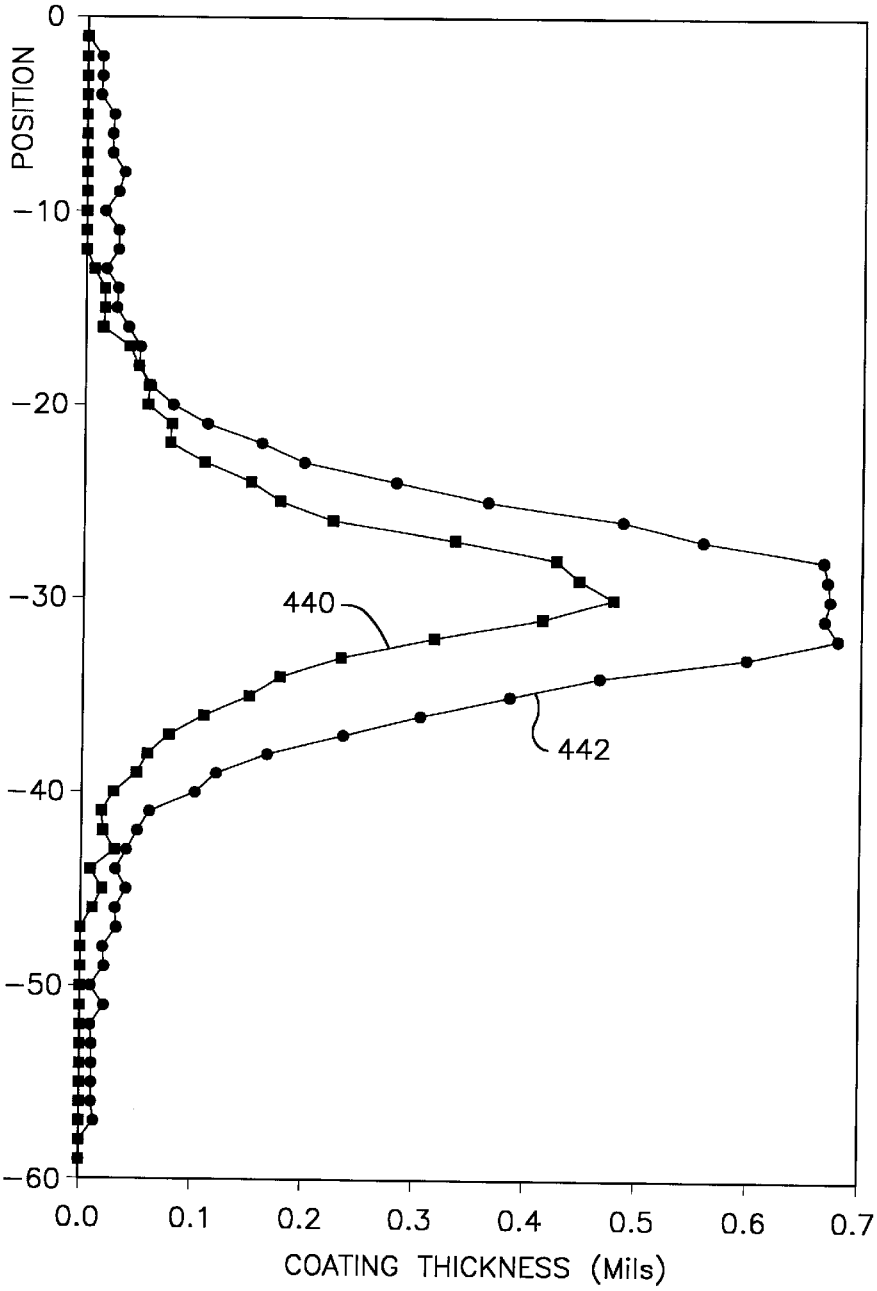
FIG. 22 is a graph depicting the distribution of coating material on the flat object of FIG. 19 when a known spray head is used to apply the coating material.

The graph of FIG. 22 is to the same scale as the graph of FIGS. 20 and 21. The graph of FIG. 22 illustrates the results of applying coating material to the flat thin plate 412 with the known "Versa-Spray II" four mm flat spray gun.

During the application of the coating material to the flat plate 412 with the known spray gun, the spray head of the spray gun was spaced ten inches from the flat thin plate. The coating material pattern which is obtained on the plate at a relatively low powder flow rate of 150 grams/minute (20 lbs./hr) is illustrated by the curve 440 in FIG. 22. The powder application pattern which is obtained with a relatively high flow rate of powder, that is, 300 grams/minute (40 lbs./hr) is depicted by the curve 442 in FIG. 22.

The maximum thickness of the pattern which was applied with the known spray gun is substantially greater than the maximum thickness of the pattern which is obtained with a spray gun using the spray head 34 with either the deflector 82 or the deflector 82*a*. In addition, the pattern width which is obtained with the known spray gun is somewhat smaller than the pattern width which is obtained with the deflector 82 and is substantially smaller than the pattern width which is obtained with the deflector 82*a*.

At low flow rates, the coating material transfer efficiency which is obtained with the known spray gun is slightly less than the coating material transfer efficiency which is obtained with the spray head 34 using either the deflector 82 or the deflector 82*a*. However, when high powder flow rates are used (300 grams/minute), the coating material transfer efficiency which was obtained with the known spray gun is substantially less than the transfer efficiency which is obtained with the spray head 34.

In regard to FIG. 22, the maximum thickness of the pattern which is obtained with the known spray gun at low powder flow rates (150 grams/minute) is approximately 4.8 mils (0.0048 inches). If the effective pattern width is considered to occur at one-half of the maximum thickness of the pattern, at low flow rates, indicated by the curve 440 in FIG. 22, the pattern will have an effective width of approximately seven inches. The powder transfer efficiency for the low flow rate operation of the known spray gun is approximately 89.1%.

The curve 442 in FIG. 22 represents the pattern configuration for the high powder flow rate (300 grams/minute). The maximum thickness of the pattern at the high powder flow rate, indicated by the curve 442, is approximately 6.8 mils (0.0068 inches). If the effective pattern width is considered as being one-half of the maximum thickness of the pattern, the high flow rate pattern for the known spray gun, represented by the curve 442 in FIG. 22, has an effective pattern width of approximately eleven inches. The average powder transfer efficiency for the known spray gun at the high flow rate (300 grams/minute) was approximately 76.5%.

A comparison of the pattern obtained with the known "Versa-Spray II" 4 mm flat spray nozzle, the deflector 82 of FIG. 9 with the housing 80 of FIGS. 4 and 5, and the deflector 82*a* of FIG. 18 with the housing of FIGS. 4 and 5 is indicated by the chart set forth below.

| DEFLECTOR | HIGH OR LOW POWDER FLOW RATE | EFFECTIVE PATTERN WIDTH [IN] | MAXIMUM FILM BUILD [MILS] | TRANSFER EFFICIENCY [%] |
|---|---|---|---|---|
| Known 4 MM FS | LOW | 7 | 4.8 | 89.1 |
| Known 4 MM FS | HIGH | 11 | 6.8 | 76.5 |
| 82 of FIG. 9 | LOW | 12.5 | 3.3 | 93.4 |
| 82 of FIG. 9 | HIGH | 13 | 3.7 | 89.7 |
| 82a of FIG. 18 | LOW | 24 | 3.2 | 92.7 |
| 82a of FIG. 18 | HIGH | 24 | 3.6 | 89.0 |

Low Powder Flow Rate = 150 grams/minute (20 lbs./hr)
High Powder Flow Rate = 300 grams/minute (40 lbs./hr)

During the application of coating material to a flat plate 412 with the spray heads set forth in the chart set forth above, the spray heads were spaced ten inches from the plate. Outlets from the spray heads were oriented with longitudinal axes of the outlets in a vertical position.

The foregoing chart clearly indicates that the maximum film build up (pattern thickness) is less with the spray head 34 which is constructed in accordance with the present invention and using the deflector 82 of FIG. 9 or the deflector 82*a* of FIG. 18. In addition, the foregoing chart indicates that the pattern width which can be obtained at either low powder flow rates or high powder flow rates is greater with the improved spray head 34 of the present invention when it is used with either the deflector 82 of FIG. 9 or the deflector 82*a* of FIG. 18. The improved spray head 34 obtains a greater transfer efficiency of powder, particularly at high powder flow rates. The improved transfer efficiency at high powder flow rates is significant since it represents a continuous reduction in the amount of powder required during a production operation.

Although the foregoing description has related to spray heads having outlets with vertical central axes, the spray heads could be placed in a different orientation if desired. It is also contemplated that the spray heads could be moved relative to the object to be coated by either suitable equipment or an operator. The spray heads may be used to apply many different types of coating materials.

Electrode Arrangement—Alternative Embodiments

In the embodiment of the invention illustrated in FIGS. 1–15, the deflector 82 contained an electrode element 110 which is formed by a flat metal plate 364 (FIGS. 16 and 17). It is contemplated that the electrode element 110 could have a configuration other than the flat plate configuration of FIGS. 16 and 17. For example, the flat thin surface area 112 of the electrode element 110 could be disposed on a relatively thin metal strip which is mounted on the deflector 82 at the same location as the long thin side surface area 112. Rather than forming the electrode element 110 of metal, the electrode element could be fabricated of a resistive material, such as a nonwoven silicon carbide fabric in the manner disclosed in U.S. Pat. No. 4,819,879 issued Apr. 11, 1989 to Sharpless et al. and entitled "Particle Spray Gun". The disclosure in the aforementioned U.S. Pat. No. 4,819,879 is hereby incorporated herein by this reference thereto.

Figure 23:
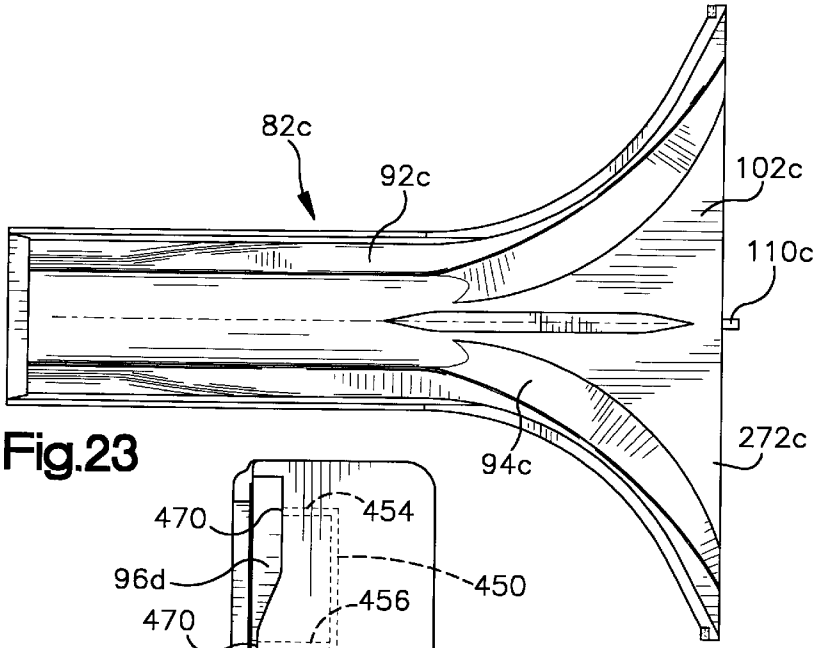
FIG. 23 (on sheet 12 of the drawings) is a top plan view, generally similar to FIG. 9, of an alternative embodiment of the deflector in which a rod-shaped electrode extends from the deflector.

In the embodiment of the deflector illustrated in FIG. 23, a single metal rod extends from the front (downstream end) of the deflector and is utilized as an electrode. Since the embodiment of the invention illustrated in FIG. 23 is generally similar to the embodiment of the invention illustrated in FIGS. 1–15, similar numerals will be utilized to designate similar components, the suffix letter "c" being associated with the numerals of FIG. 23 to avoid confusion.

A deflector 82*c* has upper and lower channels 92*c* and 94*c* through which powder flows. The deflector 82*c* cooperates with a housing 80 to define a long thin outlet having the same configuration as the outlet 88 of FIG. 3. A wide thin slot channel 102*c* extends between the upper and lower channels 92*c* and 94*c*.

In accordance with a feature of this embodiment of the invention, an electrode element 110*c* extends from a rectangular outer end portion 272*c* of the deflector 82*c*. The electrode element 110*c* is formed by a cylindrical metal rod. When the deflector 82*c* is molded of a suitable electrically insulating material, the electrode element or rod 110*c* has a relatively long length which enables the rod to be positioned in the mold. After the polymeric insulating material forming the deflector 82*c* has solidified around the rod or electrode element 110*c*, the deflector 82*c* is removed from the mold. The electrode element or rod 102*c* is then cut to the desired length.

Figure 24:
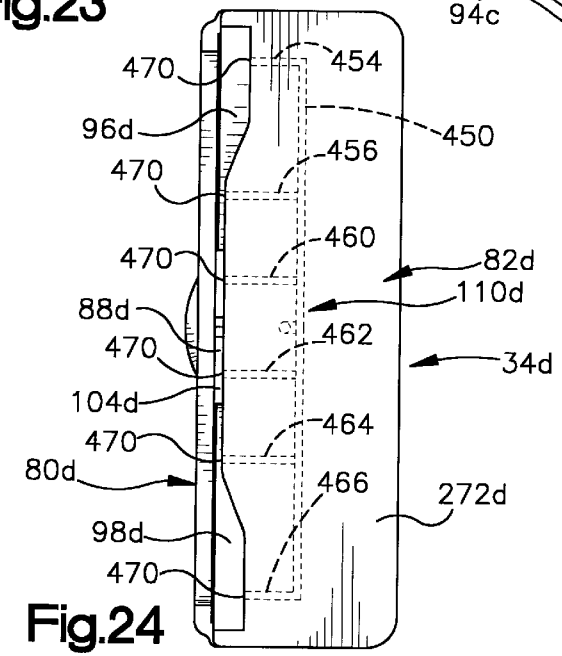
FIG. 24 (on sheet 12 of the drawings) is an end view, generally similar to FIG. 3, of an alternative embodiment of the spray head in which a plurality of rod-shaped electrodes are provided at the outlet from the spray head.

In the embodiment of the invention illustrated in FIG. 24, the electrode element is formed by a plurality of interconnected rods which are flush with and do not extend into the long thin outlet opening formed between the housing and deflector. Since the embodiment of the invention illustrated in FIG. 24 is generally similar to the embodiment of the invention illustrated in FIGS. 1–15, similar numerals will be utilized to designate similar components, the suffix letter "d" being associated with the numerals of FIG. 24 to avoid confusion.

A spray head 34*d* includes a housing 80*d* which encloses a deflector 82*d*. The housing 80*d* and deflector 82*d* cooperate to define a long thin outlet 88*d*. The long thin outlet 88*d* includes an upper channel outlet portion 96*d* and a lower channel outlet portion 98*d*. A slot outlet portion 104*d* extends between the upper channel outlet portion 96*d* and lower channel outlet portion 98*d*. The configuration of the long thin outlet 88*d* and the manner in which it is formed by cooperation between the housing 80*d* and deflector 82*d* is the same as was previously described in conjunction with the embodiment of the invention illustrated in FIGS. 1–15.

In accordance with a feature of the embodiment of the invention illustrated in FIG. 24, an electrode element 110*d* is formed by a plurality of cylindrical metal rods having end portions which are exposed to the flow of coating material through the long thin outlet 88*d*. The electrode element 110*d* includes a main or base rod 450 which extends across the outer end portion 272*d* of the deflector 82*d* in a direction perpendicular to coincident longitudinal central axes of the deflector 82*d* and housing 80*d*.

A plurality of secondary rods 454, 456, 460, 462, 464 and 466 extend from the base rod 450 into the long thin outlet 88*d*. The base rod 450 is connected with a metal conductor rod corresponding to the metal conductor rod 362 of FIGS. 12, 16 and 17. Each of the secondary rods 454–466 has an end surface 470 which is exposed to the flow of air entrained powder through the long thin outlet 88*d*. The exposed surfaces 470 on the secondary rods 454–466 are aligned with side surfaces of the deflector 82*d*.

The secondary rod 454 has an end surface 470 which is exposed to the flow of air entrained powder conducted through the upper channel outlet portion 96*d*. The secondary rod 466 has an end surfaces 470 which is exposed to the flow of air entrained powder through the lower channel outlet portion 98*d*. The secondary rods 456, 460, 462 and 464 have end surfaces 470 which are exposed to the flow of air entrained powder through the slot outlet portion 104*d* of the long thin outlet 88*d*.

The base rod 450 and secondary rods 454–466 of the electrode element 110 are embedded in the electrically insulating material which forms the deflector 82*d*. When the deflector 82*d* is to be molded, the secondary rods 454–466 have a relatively long length which enables them to be gripped to position the electrode element 110*d* in the mold. The liquid electrically insulating polymeric material from which the deflector 82*d* is formed is injected into the mold and solidified around the electrode element 110*d*. After the material forming the deflector 82*d* has solidified, the deflector is removed from the mold and the secondary rods 454–466 are cut to the desired length.

If desired, the electrode element 110*d* could be formed by a plate having a saw-toothed edge portion. Pointed ends of the saw teeth on the edge portion of the electrode plate would be exposed to the flow of coating material.

Conclusion

The present invention provides a new and improved apparatus 30 for use in applying coating material to an object. The apparatus includes a spray head 34 having a long thin outlet 88 through which the coating material is conducted from the spray head. The long thin outlet 88 has a central portion 104 which extends between end portions 96 and 98 of the outlet. The coating material is conducted through the central portion 104 of the outlet 88 at a flow rate which is less than the rate of flow of coating material through the end portions 96 and 98 of the outlet.

The spray head 34 is formed by a deflector 82 which is at least partially enclosed by a housing 80. The deflector 82 and housing 80 cooperate to form a plurality of channels 92 and 94 which diverge in the direction of flow of coating material through the spray head 34. The channels 92 and 94 conduct the flow of coating material to the opposite end portions 96 and 98 of the long thin outlet 88. A thin slot channel 102 is disposed in the spray head 34 and conducts the flow of coating material to the central portion 104 of the outlet.

An electrode assembly 68 is connected with the spray head 34 to electrostatically charge the coating material. The electrode assembly includes an electrode element 110 having a long thin surface area 112. The long thin surface area 112 extends between opposite end portions 96 and 98 of the long thin outlet 88 and is exposed to the flow of coating material through the outlet. In alternative embodiments of the spray head (FIGS. 23 and 24), the electrode element is formed by one or more wires.

The deflector 82 and the housing 80 of the spray head 34 are interconnected by a wear tube 84. The wear tube 84 encloses a portion of the electrode assembly 68 to shield a portion of the electrode assembly from a flow of coating material. The wear tube 84 transmits forces between the deflector 82 and the housing 80 to hold them against movement relative to each other.

In the foregoing description, specific dimensions and/or materials have been set forth for components of the spray head 34. In addition, the spray head 34 has been described as being used in a specific orientation to apply coating materials at specific flow rates. Specific dimensional characteristics of coating material patterns applied to objects have been described. It should be understood that these specific dimensions, materials, spray head orientation, and coating material pattern characteristics have been set forth herein for purposes of clarity of description. It is contemplated that any one or all of these or other specifics of the description may be different in different embodiments of the invention.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for use in applying coating material to an object, said apparatus comprising a housing through which a flow of coating material is conducted, and a deflector which is at least partially enclosed by said housing, said deflector and housing cooperating to form a plurality of channels which diverge in a direction of flow of coating material through said housing and which conduct coating material to an outlet, said outlet having channel outlet sections and a slot outlet section which extends between said channel outlet sections.

2. An apparatus as set forth in claim 1 further including an electrode assembly connected with said deflector and said housing to electrostatically charge particles of coating material conducted through said outlet.

3. The apparatus set forth in claim 1 wherein said deflector is removable from said housing.

4. The apparatus as set forth in claim 3 wherein said housing is adapted to alternately receive both a first deflector having a first geometry which produces a first spray pattern, and a second deflector having a second geometry which produces a second spray pattern, said second spray pattern being wider than said first spray pattern.

5. The apparatus set forth in claim 3 wherein said housing has a rear opening for connection to a powder spray gun and an elongated front opening for removably receiving said deflector.

6. The apparatus set forth in claim 5 further comprising an electrode assembly carried by said deflector to electrostatically charge powder coating materials sprayed from said spray guns.

7. The apparatus of claim 6 wherein said electrode has an edge which extends along at least a part of the length of said outlet.

8. The apparatus of claim 7 wherein said electrode edge extends along at least more than one-half of the length of said outlet.

9. The apparatus of claim 8 wherein said electrode edge extends along the entire length of said outlet.

10. An apparatus as set forth in claim 1 wherein said channel outlet sections have first widths in a direction transverse to a longitudinal central axis of said slot outlet section, said slot outlet section having a second width in the direction transverse to the longitudinal central axis of said slot outlet section, said second width being smaller than said first width.

11. An apparatus as set forth in claim 1 further including an electrode assembly connected with said deflector to establish an electrical field which electrostatically charges particles of coating material which pass through the electrical field.

12. An apparatus as set forth in claim 11 wherein said deflector is at least partially formed of a molded electrically insulating material, said electrode assembly includes an electrode element having a surface which is exposed to the flow of coating material and from which at least a portion of the electrical field emanates, said electrode element being at least partially embedded in the electrically insulating material of said deflector, said electrically insulating material being molded around at least a portion of said electrode element.

13. An apparatus as set forth in claim 11 wherein said electrode assembly includes an electrode which has a surface area which extends from a first one of said channel outlet sections along said slot outlet section to a second one of said channel outlet sections, said surface area on said electrode being exposed to the flow of coating material.

14. An apparatus as set forth in claim 13 wherein said deflector has an outer side which faces toward the object, said surface area on said electrode being offset from said outer side of said deflector in a direction opposite to a direction of flow of coating material through said outlet.

15. An apparatus as set forth in claim 14 wherein said surface area on said electrode faces toward the flow of coating material through said outlet.

16. An apparatus as set forth in claim 14 wherein said deflector includes a side along which the coating material flows and which at least partially defines said channel outlet sections and said slot outlet section of said outlet, said surface area on said electrode being aligned with said side of said deflector.

17. An apparatus as set forth in claim 13 wherein said electrode includes a plate member which is embedded in material forming said deflector, said surface area on said electrode being disposed on an edge portion of said plate member.

18. An apparatus as set forth in claim 1 wherein each of said channels of said plurality of channels includes a linear portion and an arcuately curving portion which curves away from a central axis of said housing in the direction of flow of coating material.

19. An apparatus as set forth in claim 1 wherein each of said channels has a longitudinally extending bottom surface and a pair of side surfaces, said longitudinally extending bottom surface of each of said channels slopes in the direction of flow of coating material throughout at least a portion of the length of each of said channels to decrease the depth of said channels in the direction of flow of coating material through said channels, said side surfaces of each of said channels diverging in the direction of flow of coating material throughout at least a portion of the length of said channels to increase the width of said channels in the direction of flow of coating material through said channels.

20. An apparatus as set forth in claim 1 wherein said deflector includes a side surface area which extends between said channels and increases in size in the direction of flow of coating material through said housing, said side surface area on said deflector cooperating with said housing to form said slot outlet section of said outlet.

21. An apparatus as set forth in claim 20 wherein said deflector includes a rib which projects from said side surface area of said deflector toward an inner side surface of said housing to maintain a minimum spacing between said inner side surface of said housing and said side surface area of said deflector throughout the extent of said rib.

22. An apparatus as set forth in claim 21 wherein said rib has a longitudinal central axis which extends parallel to a longitudinal central axis of said housing, each one of said channels having a first portion which extends parallel to th e longitudinal central axis of said housing and a second portion which diverges from the longitudinal central axis of said housing in the direction of flow of coating material through said one of said channels, said rib being disposed midway between said channels throughout the extent of said rib.

23. An apparatus as set forth in claim 1 wherein said housing includes an inlet passage through which coating material enters said housing, said channels having inlets which are at least partially disposed on opposite sides of a longitudinal central axis of said inlet passage, and a flow divider disposed in said inlet passage to divide at least a portion of the flow of coating material in said inlet passage into a first portion which enters a first one of said channels and a second portion which enters a second one of said channels, said flow divider having a pair of side surfaces which diverge in a direction of flow of coating material through said inlet passage.

24. An apparatus as set forth in claim 1 wherein said housing includes an inlet passage through which coating material enters said housing, said channels having inlets which are at least partially disposed on opposite sides of a longitudinal central axis of said housing, said apparatus further includes an electrode assembly which extends along the longitudinal central axis of said inlet passage, said housing includes a support section which extends across said inlet passage between said inlets to said channels, said electrode assembly extends through an opening in said support section, and a wear tube which encloses a portion of said electrode assembly and extends through the opening in said support section into engagement with a portion of said deflector disposed between said channels.

25. An apparatus as set forth in claim 24 wherein said wear tube has a shoulder which is disposed in abutting engagement with a side of said support section which faces in a direction opposite to the direction of flow of coating material through said inlet passage, said wear tube having an externally threaded end portion which engages an internally threaded opening in said deflector to apply force against said deflector urging said deflector toward said support section.

26. An apparatus as set forth in claim 25 wherein said deflector includes an outer end portion which cooperates with an outer end portion of said housing to block movement of said deflector toward said support section o f said housing under the influence of force transmitted to said deflector through said wear tube.

27. An apparatus as set forth in claim 26 wherein said deflector has an inner end portion which is disposed adjacent to said support section of said housing, said wear tube being effective to transmit force between said support section of said housing and said deflector to urge said deflector toward said support section of said housing.

28. An apparatus as set forth in claim 1 further including an electrode extending outward from said deflector in the direction of flow of coating material through said outlet to establish an electrical field which electrostatically charges particles of coating material which pass through the electrical field.

29. An apparatus as set forth in claim 1 further including an electrode extending from said deflector in a direction transverse to the direction of flow of coating material through said outlet to establish an electrical field which electrostatically charges particles of coating material which pass through the electrical field.

30. Apparatus as set forth in claim 1 wherein said outlet includes a linear edge portion and a nonlinear edge portion, said nonlinear edge portion of said outlet having a linear segment which extends parallel to said linear edge portion and at least partially defines said slot outlet section.

31. An apparatus as set forth in claim 1 wherein said outlet includes a linear edge portion which extends between opposite ends of said outlet and a nonlinear edge portion, said nonlinear edge portion includes a first segment which cooperates with said linear edge portion to at least partially define a first one of said channel outlet sections and a second segment which cooperates with said linear edge portion to at least partially define a second one of said channel outlet sections.

32. An apparatus as set forth in claim 31 wherein said nonlinear edge portion includes a third segment which is disposed between said first and second segments and cooperates with said linear edge portion to at least partially define said slot outlet section.

33. An apparatus as set forth in claim 1 wherein each of said channels includes an arcuately curving portion which curves away from a longitudinal central axis of said deflector and ends at one of said channel outlet sections.

34. An apparatus as set forth in claim 1 wherein a first width of said channel outlet sections is more than twice as great as a second width of said slot outlet section.

35. An apparatus as set forth in claim 1 wherein said channels and said outlet cooperate to apply coating material to an object in a pattern having a maximum thickness of less than four thousandths (0.004) of an inch and an effective width of ten (10) inches or more as measured at a portion of the coating material pattern having a thickness of one half of the maximum thickness of the coating material pattern.

36. An apparatus for use in applying coating material to an object, said apparatus comprising a spray head through which a flow of coating material is conducted toward an object, said spray head having a long thin outlet through which the flow of coating material is conducted from said spray head, and an electrode assembly connected with said spray head for use in establishing an electrical field through which the flow of coating material is conducted to electrostatically charge the coating material, said electrode assembly includes an electrode element having a long thin surface area which extends between opposite end portions of said long thin outlet and is exposed to the flow of coating material through said outlet, wherein said spray head includes an inlet passage and first and second channels which extend away from said inlet passage to said long thin outlet, said first channel extends from said inlet passage to a first one of said opposite end portions of said long thin outlet and said second channel extends from said inlet passage to a second one of said opposite end portions of said long thin outlet, said first and second end portions of said long thin outlet being separated by a central portion of said long thin outlet.

37. An apparatus as set forth in claim 36 wherein said spray head is at least partially formed of electrically insulating polymeric material which is molded around said electrode element and covers surfaces of said electrode element other than said long thin surface area.

38. An apparatus as set forth in claim 36 wherein said electrode element is a plate having a pair of major side surfaces interconnected by a plurality of edge portions, said long thin surface area being disposed on one of said edge portions of said plate.

39. An apparatus as set forth in claim 36 wherein said spray head has an end surface which faces toward the object, said long thin surface area on said electrode element being spaced from said end surface of said spray head in a direction opposite to the direction of flow of coating material through said long thin outlet.

40. An apparatus as set forth in claim 36 wherein said spray head includes a first portion having a surface area which extends parallel to the direction of flow of coating material from said long thin outlet and which at least partially defines said long thin outlet, said long thin surface area on said electrode element being disposed in a coplanar relationship with said surface area on said first portion of said spray head.

41. An apparatus as set forth in claim 36 wherein said long thin surface area on said electrode element is adjacent to a first edge portion of said long thin outlet, said spray head includes a side surface area which extends outward from a second edge portion of said long thin outlet in a direction of flow of coating material through said long thin outlet, said side surface area which extends outward from said second edge portion of said long thin outlet extends further from said long thin outlet toward the object than said first edge portion of said long thin outlet.

42. An apparatus as set forth in claim 36 wherein said spray head has a longitudinal central axis which extends perpendicular to a longitudinal central axis of said long thin outlet and to a longitudinal central axis of said long thin surface area on said electrode element, said electrode assembly includes a conductor element which extends from said electrode element in a direction along the central axis of said spray head to a location adjacent to an inlet portion of said spray head through which coating material enters said spray head, said electrode element and said conductor element of said electrode assembly being embedded in electrically insulating material of said spray head, said electrically insulating material of said spray head being molded as one piece around said electrode element and conductor element.

43. An apparatus as set forth in claim 42 wherein said spray head includes first and second channels which are disposed along opposite sides of said conductor element and conduct coating material to opposite end portions of said long thin outlet.

44. An apparatus as set forth in claim 36 wherein a first end portion of said long thin surface area on said electrode element is disposed adjacent to said first end portion of said long thin outlet, a second end portion of said long thin surface area on said electrode element is disposed adjacent to said second end portion of said long thin outlet, and a central portion of said long thin surface area on said electrode element is disposed adjacent to said central portion of said long thin outlet.

45. An apparatus as set forth in claim 44 wherein said long thin surface area on said electrode element is offset from said long thin outlet in a direction opposite to the direction of flow of coating material through said spray head.

46. An apparatus as set forth in claim 36 wherein said first and second channels decrease in depth and increase in width as said first and second channels extend from said inlet passage to said long thin outlet.

47. An apparatus as set forth in claim 36 further including a flow divider having a generally V-shaped cross sectional configuration as viewed in a plane extending parallel to a longitudinal central axis of said spray head and to a longitudinal central axis of said long thin outlet, said flow divider having a first side surface area which deflects a flow of coating material from said inlet passage into said first channel and a second side surface area which deflects a flow of coating material from said inlet passage into said second channel.

48. An apparatus as set forth in claim 36 wherein said electrode element is a plate having a plurality of openings formed therein, said plate being embedded in electrically insulating material of said spray head, said electrically insulating material of said spray head being molded as one piece which extends around said plate and through the openings in said plate.

49. An apparatus as set forth in claim 36 wherein said long thin outlet is at least partially defined by a linear edge portion and a nonlinear edge portion, said long thin surface area on said electrode element being disposed adjacent to one of said edge portions and being at least substantially coextensive with said one edge portion of said outlet.

50. An apparatus as set forth in claim 36 wherein said long thin surface area on said electrode element forms a continuous surface which extends between opposite end portions of said long thin outlet.

51. An apparatus as set forth in claim 36 wherein said spray head includes a housing and a deflector which is at least partially enclosed by said housing, said deflector and said housing cooperating to at least partially define said long thin outlet through which a flow of coating material is conducted toward the object, said long thin surface area on said electrode element being connected to said deflector.

52. An apparatus for use in applying coating material to an object, said apparatus comprising a spray head through which a flow of coating material is conducted toward the object, said spray head having a long thin outlet through which the flow of coating material is conducted from said spray head, and an electrode assembly connected with said spray head for use in establishing an electrical field through which the flow of coating material is conducted to electrostatically charge the coating material, said electrode assembly includes an electrode element having a long thin surface area which extends between opposite end portions of said long thin outlet and is exposed to the flow of coating material through said outlet, wherein said long thin outlet includes first and second sections disposed at opposite ends of said long thin outlet and a third section which is disposed between said first and second sections of said outlet, said third section of said long thin outlet having a width in a direction transverse to a longitudinal central axis of said long thin outlet which is less than a width of said first and second sections of said long thin outlet, said long thin surface area on said electrode element has a first section which is exposed to a flow of coating material conducted through said first section of said long thin outlet, said long thin surface area on said electrode element has a second section which is exposed to a flow of coating material conducted through said second section of said long thin outlet, said long thin surface area on said electrode element has a third section which is exposed to a flow of coating material conducted through said third section of said long thin outlet.

53. An apparatus for use in applying coating material to an object, said apparatus comprising a spray-head through which a flow of coating material is conducted toward the object, said spray head having a long thin outlet through which the flow of coating material is conducted from said spray head, said long thin outlet having first and second end portions and a central portion which extends between said first and said second end portions and through which coating material is conducted at a flow rate which is less than the flow rate at which coating material is conducted through said first and second end portions of said long thin outlet.

54. An apparatus as set forth in claim 53 wherein said spray head includes surface means for directing at least a portion of the flow of coating material through said first end portion of said long thin outlet away from said central portion of said long thin outlet in a first direction and for directing at least a portion of the flow of coating material through said second end portion of said long thin outlet away from said central portion of said long thin outlet in a second direction opposite to the first direction to apply the coating material to the object in a spray pattern having a maximum thickness of less than four thousandths (0.004) of an inch and an effective width of ten (10) inches or more as measured at a portion of the coating material spray pattern having a thickness of one-half of the maximum thickness of the coating material spray pattern.

55. An apparatus as set forth in claim 53 wherein said spray head includes a first channel which conducts coating material to said first end portion of said long thin outlet, a second channel which conducts coating material to said second end portion of said long thin outlet, and a wide passage which conducts coating material to said central portion of said long thin outlet, said wide thin passage being disposed between said first and second channels and having a depth measured in a direction perpendicular to the direction of flow of coating material through said wide passage and perpendicular to a longitudinal central axis of said long thin outlet which is less than the depth of said first and second channels as measured in a direction perpendicular to the direction of flow of coating material through said wide passage and the central axis of said long thin outlet.

56. An apparatus as set forth in claim 53 further including an electrode element embedded in electrically insulating material which forms at least a portion of said spray head, said electrode element having a long thin exposed surface area which is disposed adjacent to said long thin outlet.

57. An apparatus as set forth in claim 53 wherein said spray head includes a housing and a deflector which is at least partially enclosed by said housing, said deflector having a rectangular outer end portion having one edge portion which cooperates with one side of a rectangular end portion of said housing to define said long thin outlet.

58. An apparatus as set forth in claim 53 wherein said spray head includes a housing and a deflector which cooperate to define said long thin outlet, said apparatus further including an electrode assembly which is used to establish an electrical field which electrostatically charges particles of coating material, and a wear tube which encloses a portion of said electrode assembly, said wear tube extends through a support section of said -housing into engagement with said deflector to transmit force between said housing and deflector to retain said housing against movement relative to said deflector.

59. An apparatus as set forth in claim 53 wherein said spray head includes a housing through which coating material is conducted and a deflector which is connected with said housing and is at least partially enclosed by said housing, said deflector and housing having outer end portions which cooperate to at least partially define said long thin outlet, said apparatus further including an electrode assembly which extends through said housing and to said outer end portion of said deflector, and a wear tube which at least partially encloses said electrode assembly and transmits force between said deflector and said housing to press said outer end portion of said deflector against said outer end portion of said housing.

60. An apparatus as set forth in claim 53 wherein said spray head includes a first channel which conducts a flow of coating material and has an arcuate portion which curves away from a longitudinal central axis of said spray head in a first direction and ends at said first end portion of said long thin outlet and a second channel which conducts a flow of coating material and has an arcuate portion which curves away form a longitudinal central axis of said spray head in a second direction opposite to the first direction and ends at said second end portion of said long thin outlet.

61. An apparatus for use in applying coating material to an object, said apparatus comprising a housing, a deflector which is at least partially enclosed by said housing, an electrode assembly which extends into said housing and said deflector to establish an electric field which is effective to electrostatically charge the flow of coating material, and a wear tube which encloses a portion of said electrode assembly to shield a portion of said electrode, assembly from the flow of coating material, said wear tube being connected with said deflector and with said housing to transmit force between said deflector and said housing to press said deflector against said housing, wherein said deflector and housing cooperate to form a plurality of channels which diverge in a direction of flow of coating material through said housing, said deflector and housing having outer end portions which cooperate to form a long thin outlet through which coating material is conducted toward the object, a first one of said channels ends at a first end portion of said long thin outlet and a second one of said channels ends at a second end portion of said long thin outlet to enable coating material conducted through said first and second channels to be conducted through said first and second end portions of said long thin outlet.

62. An apparatus as set forth in claim 61 wherein said housing includes an inlet passage through which coating material enters said housing, said wear tube being at least partially disposed in said inlet passage and exposed to a flow of coating material through said inlet passage.

63. An apparatus as set forth in claim 61 wherein said wear tube includes a threaded end portion which engages said deflector and a shoulder portion which engages said housing, said wear tube being rotatable about a central axis of said wear tube to pull said deflector toward said shoulder portion of said wear tube and press said deflector against said housing.

64. An apparatus as set forth in claim 63 wherein said housing includes a cylindrical wall which is disposed in a coaxial relationship with said inlet passage, and said wear tube extends through said cylindrical wall and is disposed in a coaxial relationship with said cylindrical wall, said wear tube being disposed in engagement with said cylindrical wall and said deflector to transmit force between said cylindrical wall and said deflector.

* * * * *